US009500972B2

(12) United States Patent
Tanaka et al.

(10) Patent No.: US 9,500,972 B2
(45) Date of Patent: Nov. 22, 2016

(54) TONER

(71) Applicant: CANON KABUSHIKI KAISHA, Tokyo (JP)

(72) Inventors: Masatake Tanaka, Yokohama (JP); Yoshihiro Nakagawa, Numazu (JP); Naoya Isono, Suntou-gun (JP); Tsutomu Shimano, Mishima (JP); Shintaro Noji, Mishima (JP); Yu Yoshida, Mishima (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/554,832

(22) Filed: Nov. 26, 2014

(65) Prior Publication Data

US 2015/0153668 A1 Jun. 4, 2015

(30) Foreign Application Priority Data

Nov. 29, 2013 (JP) ..... 2013-247691

(51) Int. Cl.
*G03G 9/087* (2006.01)
*G03G 9/08* (2006.01)

(52) U.S. Cl.
CPC ..... *G03G 9/08711* (2013.01); *G03G 9/0804* (2013.01); *G03G 9/08755* (2013.01); *G03G 9/08788* (2013.01); *G03G 9/08795* (2013.01); *G03G 9/08797* (2013.01)

(58) Field of Classification Search
CPC ..... G03G 9/08711; G03G 9/08788; G03G 9/08795; G03G 9/08797
See application file for complete search history.

(56) References Cited

U.S. PATENT DOCUMENTS 8,609,316 B2 12/2013 Hara et al.
2009/0068578 A1* 3/2009 Murakami ..... G03G 9/0808 430/105
2013/0280649 A1* 10/2013 Nagasawa ..... G03G 9/09733 430/108.4
2014/0302437 A1 10/2014 Shimano et al.

FOREIGN PATENT DOCUMENTS

JP 2006-113473 A 4/2006
JP 2011-141489 A 7/2011

OTHER PUBLICATIONS

U.S. Appl. No. 14/555,536, filed Nov. 26, 2014. Inventor: Tsutomu Shimano, et al.
U.S. Appl. No. 14/554,802, filed Nov. 26, 2014. Inventor: Shintaro Noji, et al.
U.S. Appl. No. 14/555,525, filed Nov. 26, 2014. Inventor Naoya Isono, et al.

* cited by examiner

*Primary Examiner* — Peter Vajda
(74) *Attorney, Agent, or Firm* — Fitzpatrick, Cella, Harper & Scinto

(57) ABSTRACT

A toner that comprises a toner particle that contains a binder resin that contains a styrene-acrylic resin and a block polymer, wherein the block polymer has a polyester segment and a vinyl polymer segment; the polyester segment is obtained by condensation polymerization of: a monomer (a) selected from a group consisting of a prescribed monomer group A; and a monomer (b) selected from a group consisting of a prescribed monomer group B, and the content in the polyester segment of the substructure originating with the monomer (b) as calculated from the following formula is from at least 1.0 mol % to not more than 30.0 mol %: {monomer (b) [mol]/(monomer (a) [mol]+monomer (b) [mol])}×100.

10 Claims, No Drawings

TONER

BACKGROUND OF THE INVENTION

1. Field of the Invention

The present invention relates to a toner that is used in image-forming methods such as an electrophotographic method, an electrostatic recording method, and a toner jet method.

2. Description of the Related Art

There has been demand in recent years for higher speeds and lower power consumption in printers and copiers, and this has required the development of toners in which the low-temperature fixability co-exists in good balance with the heat-resistant storability.

In response to this, various investigations have been carried out into toners that use a crystalline resin-containing binder resin. A crystalline resin exhibits a high viscoelasticity, as a solid, in the temperature range below its melting point, but exhibits a sharp drop in its viscoelasticity when its melting point is exceeded, and as a consequence it can be expected that, through the utilization of this property, co-existence between the heat-resistant storability and low-temperature fixability can be brought about.

However, in actuality the crystallinity of the crystalline resin undergoes a decline in a toner that uses a crystalline resin-containing binder resin. The not fully crystallized fraction of the crystalline resin then plasticizes the binder resin, which has caused the problem of a deterioration in the heat-resistant storability.

In response to this, inventions have been introduced—in Japanese Patent Application Laid-open Nos. 2006-113473 and 2011-141489—that, through the addition of a crystal nucleating agent to the crystalline resin-containing binder resin, bring about an improvement in the heat-resistant storability by inhibiting the decline in the crystallinity of the crystalline resin.

While these inventions do bring about an inhibition of the decline in crystallinity and thus bring about an improvement in the heat-resistant storability, there is a tendency, when crystallization of the crystalline resin has been promoted with a crystal nucleating agent, for the crystals produced in the toner to exhibit an uneven distribution. When they end up being unevenly distributed toward the interior of the toner, the low-temperature fixability is then reduced; when they end up being unevenly distributed to the toner surface, the charging performance and the durability are then reduced.

SUMMARY OF THE INVENTION

The present invention provides a toner for which the heat-resistant storability and low-temperature fixability co-exist in good balance at even higher levels and for which the charging performance and durability are also excellent.

The present invention relates to a toner comprising a toner particle that contains a binder resin that contains a styrene-acrylic resin and a block polymer, wherein the block polymer has a polyester segment and a vinyl polymer segment;

the polyester segment is obtained by condensation polymerization of a monomer (a) selected from the group consisting of the monomer group A described below, and a monomer (b) selected from the group consisting of the monomer group B described below; and the content in the polyester segment of the substructure originating with the monomer (b) as calculated from the following formula is from at least 1.0 mol % to not more than 30.0 mol %:

$$\{\text{monomer } (b)\ [\text{mol}]/(\text{monomer } (a)\ [\text{mol}]+\text{monomer } (b)\ [\text{mol}])\}\times 100$$

Monomer group A: straight-chain α,ω-aliphatic diols having from at least 2 to not more than 11 carbons, straight-chain α,ω-aliphatic dicarboxylic acids having from at least 2 to not more than 13 carbons, straight-chain α,ω-aliphatic monohydroxymonocarboxylic acids having from at least 2 to not more than 12 carbons, and compounds provided by converting a carboxyl group in these compounds into an acid anhydride, alkyl ester, or lactone;

Monomer group B: straight-chain α,ω-aliphatic dicarboxylic acids having from at least 14 to not more than 24 carbons, straight-chain α,ω-aliphatic diols having from at least 12 to not more than 22 carbons, straight-chain α,ω-aliphatic monohydroxymonocarboxylic acids having from at least 13 to not more than 23 carbons, straight-chain aliphatic primary monocarboxylic acids having from at least 13 to not more than 23 carbons, straight-chain aliphatic primary monoalcohols having from at least 12 to not more than 22 carbons, and compounds provided by converting a carboxyl group in these compounds into an acid anhydride, alkyl ester, or lactone.

The present invention provides a toner for which the heat-resistant storability and low-temperature fixability co-exist in good balance at even higher levels and for which the charging performance and durability are also excellent.

Further features of the present invention will become apparent from the following description of exemplary embodiments (with reference to the attached drawings).

DESCRIPTION OF THE EMBODIMENTS

The toner of the present invention is more particularly described in the following.

As a result of intensive investigations in order to solve the problems with the prior art as described above, the present inventors discovered that a toner for which the heat-resistant storability and low-temperature fixability co-exist in good balance at even higher levels and for which the charging performance and durability are also excellent, is obtained by the presence therein of a toner particle that contains a binder resin that contains a styrene-acrylic resin and a block polymer having a special structure. The present invention was achieved based on this discovery.

That is, the toner of the present invention is a toner comprising a toner particle that contains a binder resin that contains a styrene-acrylic resin and a block polymer, wherein the block polymer has a polyester segment and a vinyl polymer segment;

the polyester segment is obtained by the condensation polymerization of a monomer (a) selected from the group consisting of the monomer group A described below and a monomer (b) selected from the group consisting of the monomer group B described below; and the content in the polyester segment of the substructure originating with the monomer (b) as calculated from the following formula is from at least 1.0 mol % to not more than 30.0 mol %

$$\{\text{monomer } (b)\ [\text{mol}]/(\text{monomer } (a)\ [\text{mol}]+\text{monomer } (b)\ [\text{mol}])\}\times 100$$

monomer group A: straight-chain α,ω-aliphatic diols having from at least 2 to not more than 11 carbons, straight-chain α,ω-aliphatic dicarboxylic acids having from at least 2 to not more than 13 carbons, straight-chain α,ω-aliphatic monohydroxymonocarboxylic acids having from at least 2 to not more than 12 carbons, and compounds provided by converting a carboxyl group in these compounds into the acid anhydride, alkyl ester, or lactone;

monomer group B: straight-chain α,ω-aliphatic dicarboxylic acids having from at least 14 to not more than 24 carbons, straight-chain α,ω-aliphatic diols having from at least 12 to not more than 22 carbons, straight-chain α,ω-aliphatic monohydroxymonocarboxylic acids having from at least 13 to not more than 23 carbons, straight-chain aliphatic primary monocarboxylic acids having from at least 13 to not more than 23 carbons, straight-chain aliphatic primary monoalcohols having from at least 12 to not more than 22 carbons, and compounds provided by converting a carboxyl group in these compounds into the acid anhydride, alkyl ester, or lactone.

The present inventors consider the mechanism by which the toner of the present invention exhibits the above-described effects is as follows.

By having the block polymer contain a vinyl polymer segment, the uneven distribution of the polyester segment in a toner having a styrene-acrylic resin as its binder resin is suppressed, notwithstanding the presence of the polyester segment in the block polymer, and an excellent dispersion state is generated.

In addition, the crystallinity of the block polymer is substantially improved by having the content in the polyester segment of the monomer (b) [mol] with respect to the total amount of the monomer (a) [mol] and monomer (b) [mol] (i.e., {monomer (b) [mol]/(monomer (a) [mol]+monomer (b) [mol])}×100) be at least 1.0 mol %. That is, a toner is provided in which a satisfactorily crystallized polyester segment is well dispersed. An excellent charging performance, durability, and heat-resistant storability are achieved as a consequence.

On the other hand, a substantial improvement in the low-temperature fixability is obtained—without impairing the effect wherein upon melting the block polymer plasticizes the styrene-acrylic resin—by having the content of the monomer (b) [mol] with respect to the total amount of the monomer (a) [mol] and monomer (b) [mol] in this polyester segment that is well dispersed in the toner be not more than 30.0 mol %.

A block polymer is defined as a polymer structured of a plurality of linearly connected blocks (The Society of Polymer Science, Japan; Glossary of Basic Terms in Polymer Science by the Commission on Macromolecular Nomenclature of the International Union of Pure and Applied Chemistry), and the present invention also operates according to this definition.

The straight-chain α,ω-aliphatic diols having from at least 2 to not more than 11 carbons in monomer group A can be exemplified by ethylene glycol, propylene glycol, 1,4-butanediol, 1,5-pentanediol, 1,6-hexanediol, 1,7-heptanediol, 1,8-octanediol, 1,9-nonanediol, 1,10-decanediol, and 1,11-undecanediol. Mixtures of these may also be used.

The straight-chain α,ω-aliphatic dicarboxylic acids having from at least 2 to not more than 13 carbons in monomer group A can be exemplified by oxalic acid, malonic acid, succinic acid, glutaric acid, adipic acid, pimelic acid, suberic acid, azelaic acid, sebacic acid, 1,9-nonanedicarboxylic acid, 1,10-decanedicarboxylic acid, and 1,11-undecanedicarboxylic acid. Mixtures of these may also be used. These may be used in the reaction in the form of the compound provided by converting the carboxyl group into the acid anhydride or the compound in which the carboxyl group has been alkyl esterified.

The straight-chain α,ω-aliphatic monohydroxymonocarboxylic acids having from at least 2 to not more than 12 carbons in monomer group A can be exemplified by hydroxyacetic acid, 3-hydroxypropionic acid, 4-hydroxybutanoic acid, 5-hydroxypentanoic acid, 6-hydroxyhexanoic acid, 7-hydroxyheptanoic acid, 8-hydroxyoctanoic acid, 9-hydroxynonanoic acid, 10-hydroxydecanoic acid, 11-hydroxyundecanoic acid, and 12-hydroxydodecanoic acid. Mixtures of these may also be used. These may be used in the reaction in the form of the compound in which the carboxyl group has been lactonized or the compound in which the carboxyl group has been alkyl esterified.

The straight-chain α,ω-aliphatic diols having from at least 12 to not more than 22 carbons in monomer group B can be exemplified by 1,12-dodecanediol, 1,13-tridecanediol, 1,14-tetradecanediol, 1,15-pentadecanediol, 1,16-hexadecanediol, 1,17-heptadecanediol, 1,18-octadecanediol, 1,19-nonadecanediol, 1,20-eicosanediol, 1,21-heneicosanediol, and 1,22-docosanediol. Mixtures of these may also be used.

The straight-chain α,ω-aliphatic dicarboxylic acids having from at least 14 to not more than 24 carbons in monomer group B can be exemplified by 1,12-dodecanedicarboxylic acid, 1,13-tridecanedicarboxylic acid, 1,14-tetradecanedicarboxylic acid, 1,15-pentadecanedicarboxylic acid, 1,16-hexadecanedicarboxylic acid, 1,17-heptadecanedicarboxylic acid, 1,18-octadecanedicarboxylic acid, 1,19-nonadecanedicarboxylic acid, 1,20-eicosanedicarboxylic acid, 1,21-heneicosanedicarboxylic acid, and 1,22-docosanedicarboxylic acid. Mixtures of these may also be used. These may be used in the reaction in the form of the compound provided by converting the carboxyl group into the acid anhydride or the compound in which the carboxyl group has been alkyl esterified.

The straight-chain α,ω-aliphatic monohydroxymonocarboxylic acids having from at least 13 to not more than 23 carbons in monomer group B can be exemplified by 13-hydroxytridecanoic acid, 14-hydroxytetradecanoic acid, 15-hydroxypentadecanoic acid, 16-hydroxyhexadecanoic acid, 17-hydroxyheptadecanoic acid, 18-hydroxyoctadecanoic acid, 19-hydroxynonadecanoic acid, 20-hydroxyeicosanoic acid, 21-hydroxyheneicosanoic acid, 22-hydroxydocosanoic acid, and 23-hydroxytricosanoic acid. Mixtures of these may also be used. These may be used in the reaction in the form of the compound in which the carboxyl group has been lactonized or the compound in which the carboxyl group has been alkyl esterified.

The straight-chain aliphatic primary monocarboxylic acids having from at least 13 to not more than 23 carbons in monomer group B can be exemplified by n-tridecanoic acid, n-tetradecanoic acid, n-pentadecanoic acid, n-hexadecanoic acid, n-heptadecanoic acid, n-octadecanoic acid, n-nonadecanoic acid, n-eicosanoic acid, n-heneicosanoic acid, n-docosanoic acid, and n-tricosanoic acid. Mixtures of these may also be used. These may be used in the reaction in the form of the compound provided by converting the carboxyl group into the acid anhydride or the compound in which the carboxyl group has been alkyl esterified.

The straight-chain aliphatic primary monoalcohols having from at least 12 to not more than 22 carbons in monomer group B can be exemplified by n-dodecanol, n-tridecanol, n-tetradecanol, n-pentadecanol, n-hexadecanol, n-heptadecanol, n-octadecanol, n-nonadecanol, n-eicosanol, n-heneicosanol, and n-docosanol. Mixtures of these may also be used.

Within a range in which the objects of the present invention are not impaired, monomer other than the monomers selected from monomer group A and monomer group B may also be reacted for the polyester segment in the block polymer in the present invention. Examples here are aromatic dicarboxylic acids, branched aliphatic dicarboxylic acids, cyclic aliphatic dicarboxylic acids, aromatic diols, branched aliphatic diols, and cyclic aliphatic diols.

Specifically, the aromatic dicarboxylic acids can be exemplified by phthalic acid, isophthalic acid, and terephthalic acid. The branched aliphatic dicarboxylic acids can be exemplified by dimethylmalonic acid, isopropylmalonic acid, diethylmalonic acid, 1-methylbutylmalonic acid, dipropylmalonic acid, and diisobutylmalonic acid.

The cyclic aliphatic dicarboxylic acids can be exemplified by 1,4-cyclohexanedicarboxylic acid and 1,3-adamantanedicarboxylic acid.

The aromatic diols can be exemplified by polyoxypropylene adducts on 2,2-bis(4-hydroxyphenyl)propane and polyoxyethylene adducts on 2,2-bis(4-hydroxyphenyl)propane.

The branched aliphatic diols can be exemplified by 3-methyl-1,3-butanediol, neopentyl glycol, pinacol, 2-ethyl-1,3-hexanediol, 2,2,4-trimethyl-1,3-pentanediol, and 3,5-dimethyl-2,4-docosanediol.

The cyclic aliphatic diols can be exemplified by 1,4-cyclohexanediol, 1,4-cyclohexanedimethanol, and 2,2-bis(4-hydroxycyclohexyl)propane.

Viewed from the standpoint of achieving additional improvements in the crystallinity, the monomer selected from monomer group B is preferably a straight-chain α,ω-aliphatic diol, a straight-chain α,ω-aliphatic dicarboxylic acid, or a straight-chain α,ω-aliphatic monohydroxymonocarboxylic acid, which are capable of introducing a plurality of units into a single polymer molecular chain.

The content of the substructure originating with this monomer (b) is more preferably from at least 4.0 mol % to not more than 20.0 mol % and is even more preferably from at least 8.0 mol % to not more than 15.0 mol %.

The content of the block polymer in the binder resin that is present in the toner particle is preferably from at least 2.0 mass % to not more than 50.0 mass % in the present invention and is more preferably from at least 6.0 mass % to not more than 50.0 mass %. When the block polymer content in the binder resin is at least 2.0 mass % (and more preferably is at least 6.0 mass %), the effect wherein upon toner melting the block polymer plasticizes the styrene-acrylic resin and the binder effect of the block polymer itself are then readily obtained and the low-temperature fixability is increased. When, on other hand, the block polymer content in the binder resin is not more than 50.0 mass %, the charge leakage originating with the polyester segment in the block polymer is suppressed and a decline in the charging performance is suppressed and the occurrence of fogging is inhibited. Moreover, since a reduction in the mechanical strength is suppressed, a decline in the durability is suppressed and image problems, e.g., development stripes, are inhibited. The block polymer content in the binder resin is more preferably from at least 10.0 mass % to not more than 45.0 mass % and is even more preferably from at least 20.0 mass % to not more than 40.0 mass %.

The mass ratio between the polyester segment and the vinyl polymer segment (the C/A ratio) in the block polymer is preferably from 40:60 to 80:20 in the present invention.

When the ratio for the vinyl polymer segment is at least 20 mass %, the properties of the vinyl polymer segment are better expressed and the heat-resistant storability, the durability, and the charging performance are then improved. When, on the other hand, the ratio for the vinyl polymer segment is not more than 60 mass %, the properties of the polyester segment are better expressed and the low-temperature fixability is improved. The mass ratio between the polyester segment and the vinyl polymer segment (the C/A ratio) in the block polymer is more preferably from 50:50 to 70:30.

The weight-average molecular weight (Mw) of the vinyl polymer segment in the block polymer is preferably from at least 3,000 to not more than 14,000 in the present invention. When the weight-average molecular weight of the vinyl polymer segment is at least 3,000, the state of dispersion of the block polymer in the toner particle during toner coagulation is improved and the effect wherein upon toner melting the block polymer plasticizes the styrene-acrylic resin is also improved, and as a consequence the durability, heat-resistant storability, and low-temperature fixability are improved. When, on the other hand, the weight-average molecular weight of the vinyl polymer segment is not more than 14,000, the block polymer itself undergoes a large viscosity decline upon melting and as a consequence the low-temperature fixability is improved.

The weight-average molecular weight (Mw) of the vinyl polymer segment in the block polymer can be controlled into the indicated range through, for example, the amount and timing of addition of the initiator and the reaction temperature.

The vinyl polymer segment is preferably produced from one or two or more polymerizable monomers selected from the following group. The polymerizable monomer can be exemplified by styrene and styrenic polymerizable monomers such as α-methylstyrene, β-methylstyrene, o-methylstyrene, m-methylstyrene, p-methylstyrene, 2,4-dimethylstyrene, p-n-butylstyrene, p-tert-butylstyrene, p-n-hexylstyrene, p-n-octylstyrene, p-n-nonylstyrene, p-n-decylstyrene, p-n-dodecylstyrene, p-methoxystyrene, and p-phenylstyrene;

acrylic polymerizable monomers such as methyl acrylate, ethyl acrylate, n-propyl acrylate, isopropyl acrylate, n-butyl acrylate, isobutyl acrylate, tert-butyl acrylate, n-amyl acrylate, n-hexyl acrylate, 2-ethylhexyl acrylate, n-octyl acrylate, n-nonyl acrylate, cyclohexyl acrylate, benzyl acrylate, dimethyl phosphate ethyl acrylate, diethyl phosphate ethyl acrylate, dibutyl phosphate ethyl acrylate, and 2-benzoyloxylethyl acrylate; and methacrylic polymerizable monomers such as methyl methacrylate, ethyl methacrylate, n-propyl methacrylate, isopropyl methacrylate, n-butyl methacrylate, isobutyl methacrylate, tert-butyl methacrylate, n-amyl methacrylate, n-hexyl methacrylate, 2-ethylhexyl methacrylate, n-octyl methacrylate, n-nonyl methacrylate, diethyl phosphate ethyl methacrylate, and dibutyl phosphate ethyl methacrylate. However, styrene is preferred from the standpoint of ease of raw material acquisition and ease of block polymer production.

The weight-average molecular weight (Mw) of the block polymer in the present invention is preferably from at least 15,000 to not more than 45,000 and is more preferably from at least 20,000 to not more than 45,000. When the weight-average molecular weight (Mw) of the block polymer is at least 15,000 (and more preferably is at least 20,000), the crystallinity of the block polymer is improved and its mechanical strength is improved as well, and as a consequence the heat-resistant storability and the durability are improved. When, on the other hand, the weight-average molecular weight (Mw) of the block polymer is not more than 45,000, sluggish molecular motion is then substantially avoided and the effect wherein upon toner melting the block polymer plasticizes the styrene-acrylic resin is increased and the low-temperature fixability is improved as a consequence.

The weight-average molecular weight (Mw) of the block polymer can be controlled into the indicated range through, for example, the amount and timing of addition of the initiator and the reaction temperature.

Viewed from the standpoint of having the low-temperature fixability and the heat-resistant storability co-exist in good balance, the melting point of the block polymer is preferably from at least 55° C. to not more than 80° C. in the present invention.

The melting point of the block polymer can be controlled into the indicated range through the monomer that will constitute the polyester segment and the mass ratio between the polyester segment and the vinyl polymer segment (the C/A ratio) for the block polymer.

A radical-polymerizable vinylic polymerizable monomer may be used in the present invention as the polymerizable monomer constituting the styrene-acrylic resin. A monofunctional polymerizable monomer or a polyfunctional polymerizable monomer can be used as this vinylic polymerizable monomer.

The monofunctional polymerizable monomer can be exemplified by the following: styrene and styrene derivatives such as α-methylstyrene, β-methylstyrene, o-methylstyrene, m-methylstyrene, p-methylstyrene, 2,4-dimethylstyrene, p-n-butylstyrene, p-tert-butylstyrene, p-n-hexylstyrene, p-n-octylstyrene, p-n-nonylstyrene, p-n-decylstyrene, p-n-dodecylstyrene, p-methoxystyrene, and p-phenylstyrene;

acrylic polymerizable monomers such as methyl acrylate, ethyl acrylate, n-propyl acrylate, isopropyl acrylate, n-butyl acrylate, isobutyl acrylate, tert-butyl acrylate, n-amyl acrylate, n-hexyl acrylate, 2-ethylhexyl acrylate, n-octyl acrylate, n-nonyl acrylate, cyclohexyl acrylate, benzyl acrylate, dimethyl phosphate ethyl acrylate, diethyl phosphate ethyl acrylate, dibutyl phosphate ethyl acrylate, and 2-benzoyloxylethyl acrylate; and methacrylic polymerizable monomers such as methyl methacrylate, ethyl methacrylate, n-propyl methacrylate, isopropyl methacrylate, n-butyl methacrylate, isobutyl methacrylate, tert-butyl methacrylate, n-amyl methacrylate, n-hexyl methacrylate, 2-ethylhexyl methacrylate, n-octyl methacrylate, n-nonyl methacrylate, diethyl phosphate ethyl methacrylate, and dibutyl phosphate ethyl methacrylate.

The polyfunctional polymerizable monomer can be exemplified by diethylene glycol diacrylate, triethylene glycol diacrylate, tetraethylene glycol diacrylate, polyethylene glycol diacrylate, 1,6-hexanediol diacrylate, neopentyl glycol diacrylate, tripropylene glycol diacrylate, polypropylene glycol diacrylate, 2,2'-bis(4-(acryloxydiethoxy)phenyl)propane, trimethylolpropane triacrylate, tetramethylolmethane tetraacrylate, ethylene glycol dimethacrylate, diethylene glycol dimethacrylate, triethylene glycol dimethacrylate, tetraethylene glycol dimethacrylate, polyethylene glycol dimethacrylate, 1,3-butylene glycol dimethacrylate, 1,6-hexanediol dimethacrylate, neopentyl glycol dimethacrylate, polypropylene glycol dimethacrylate, 2,2'-bis(4-(methacryloxydiethoxy)phenyl)propane, 2,2'-bis(4-(methacryloxypolyethoxy)phenyl)propane, trimethylolpropane trimethacrylate, tetramethylolmethane tetramethacrylate, divinylbenzene, divinylnaphthalene, and divinyl ether.

A single monofunctional polymerizable monomer may be used or a combination of two or more may be used; or, a combination of monofunctional polymerizable monomer and polyfunctional polymerizable monomer may be used; or, a single polyfunctional polymerizable monomer may be used or a combination of two or more may be used. Among these polymerizable monomers, the styrene-acrylic resin is preferably prepared—from the standpoint of the durability and developing characteristics of the toner—from styrene or a styrene derivative, either as a single selection or as a mixture of selections or as a mixture thereof with another acrylic polymerizable monomer.

The absolute value of the difference between the solubility parameter (SP) value of the styrene-acrylic resin and the solubility parameter (SP) value of the polyester segment in the block polymer (the ΔSP value) is preferably from at least 0.00 to not more than 0.30 in the present invention. By selecting the styrene-acrylic resin and the block polymer so as to provide the indicated range, a balance is readily struck between the state of phase separation during toner coagulation and the plasticization state during toner melting and the effects of the present invention can concurrently be brought to higher levels.

There are no particular limitations in the present invention on the method of producing the toner particle; however, the toner particle is preferably obtained by a toner particle production method in which the polymerizable monomer composition is granulated in an aqueous medium, such as a suspension polymerization method, an emulsion polymerization method, or a suspension granulation method.

The toner particle production method is described below using a suspension polymerization method, which is the most favorable among the toner particle production methods that may be used for the present invention.

The polymerizable monomer constituting the styrene-acrylic resin as described above, the prescribed block polymer, and other optional additives such as colorant, wax, and so forth are dissolved or dispersed to uniformity using a dispersing device such as a homogenizer, ball mill, colloid mill, or ultrasonic disperser, and a polymerization initiator is dissolved therein to produce a polymerizable monomer composition. Toner particles are then produced by polymerizing this polymerizable monomer composition with it suspended in an aqueous medium that contains a dispersion stabilizer. The polymerization initiator may be added at the same time that other additives are added to the polymerizable monomer, or it may be admixed just prior to suspension in the aqueous medium. In addition, the polymerization initiator, dissolved in solvent or polymerizable monomer, may be added immediately after granulation and before the start of the polymerization reaction.

In the case of polymerization methods that use an aqueous medium, such as suspension polymerization methods, a polar resin is preferably added to the aforementioned polymerizable monomer composition. A promotion of the encapsulation of the block polymer and wax can be pursued through this addition of a polar resin.

When a polar resin is present in the polymerizable monomer composition suspended in the aqueous medium, based on the differences in the affinity for water, the polar resin readily migrates to the neighborhood of the interface between the aqueous medium and the polymerizable monomer composition, and as a consequence the polar resin becomes to be unevenly distributed to the surface of the toner particle. The toner particle has a core-shell structure as a result.

Moreover, when a polar resin with a high melting temperature is selected for the polar resin used for the shell, the appearance of blocking during toner storage can be suppressed even in the case of a design in which the binder resin melts at a lower temperature in pursuit of low-temperature fixing.

Polyester-type resins and carboxyl-containing styrenic resins are preferred for the polar resin. By using a polyester-type resin or carboxyl-containing styrenic resin for the polar resin, the lubricity intrinsic to these resins can be expected when these resins are unevenly distributed to the surface of the toner particle to form a shell.

A resin formed by the condensation polymerization of the acid component monomer and alcohol component monomer exemplified herebelow can be used as the polyester-type resin used as a polar resin. The acid component monomer can be exemplified by terephthalic acid, isophthalic acid, phthalic acid, fumaric acid, maleic acid, malonic acid, succinic acid, glutaric acid, adipic acid, pimelic acid, suberic acid, azelaic acid, sebacic acid, camphoric acid, cyclohexanedicarboxylic acid, and trimellitic acid.

The alcohol component monomer can be exemplified by ethylene glycol, diethylene glycol, triethylene glycol, 1,2-propylene glycol, 1,3-propylene glycol, 1,4-butanediol, neopentyl glycol, the alkylene glycols and polyalkylene glycols of 1,4-bis(hydroxymethyl)cyclohexane, bisphenol A, hydrogenated bisphenols, ethylene oxide adducts on bisphenol A, propylene oxide adducts on bisphenol A, glycerol, trimethylolpropane, and pentaerythritol.

The carboxyl group-containing styrenic resin used for the polar resin is preferably, for example, a styrenic acrylic acid copolymer, a styrenic methacrylic acid copolymer, or a styrenic maleic acid copolymer, wherein styrene-acrylate ester-acrylic acid copolymers support facile control of the amount of charge and are thus preferred.

The carboxyl group-containing styrenic resin more preferably incorporates a monomer that bears a primary or secondary hydroxyl group. The specific polymer composition can be exemplified by styrene-2-hydroxyethyl methacrylate-methacrylic acid-methyl methacrylate copolymers, styrene-n-butyl acrylate-2-hydroxyethyl methacrylate-methacrylic acid-methyl methacrylate copolymers, and styrene-α-methylstyrene-2-hydroxyethyl methacrylate-methacrylic acid-methyl methacrylate copolymers. A resin that incorporates a monomer that bears a primary or secondary hydroxyl group has a high polarity and provides a better stability during long-term standing.

The content of this polar resin, expressed per 100.0 mass parts of the binder resin, is preferably from at least 1.0 mass parts to not more than 20.0 mass parts and more preferably from at least 2.0 mass parts to not more than 10.0 mass parts.

A known wax may be used in the present invention. Specific examples are petroleum waxes as typified by paraffin wax, microcrystalline wax, and petrolatum, and their derivatives; montan wax and its derivatives; hydrocarbon waxes obtained by the Fischer-Tropsch method and their derivatives; polyolefin waxes as typified by polyethylene, and their derivatives; and natural waxes as typified by carnauba wax and candelilla wax, and their derivatives, wherein the derivatives encompass the oxides as well as block copolymers and graft modifications with vinylic monomer. Other examples are alcohols such as higher aliphatic alcohols; fatty acids such as stearic acid and palmitic acid, and acid amides, esters and ketones thereof; hydrogenated castor oil and its derivatives; vegetable waxes; and animal waxes. A single one of these may be used or a combination may be used.

Among the preceding, the use of a polyolefin, a hydrocarbon wax obtained by the Fischer-Tropsch method, or a petroleum wax tends to improve the development performance and transferability and hence is preferred. An oxidation inhibitor may be added to these waxes within a range that does not exert an influence on the toner charging performance. These waxes are preferably used, expressed per 100.0 mass parts of the binder resin, at from at least 1.0 mass parts to not more than 30.0 mass parts.

The melting point of the wax used in the present invention is preferably from at least 30° C. to not more than 120° C. and more preferably from at least 60° C. to not more than 100° C.

By using a wax that has such a thermal characteristic, the release action will be efficiently expressed and a satisfactory fixing region will be maintained.

A known colorant may be used in the present invention. This colorant can be exemplified by the following organic pigments, organic dyes, and inorganic pigments.

The cyan colorant can be exemplified by copper phthalocyanine compounds and their derivatives, anthraquinone compounds, and basic dye lake compounds. Specific examples are C. I. Pigment Blue 1, C. I. Pigment Blue 7, C. I. Pigment Blue 15, C. I. Pigment Blue 15:1, C. I. Pigment Blue 15:2, C. I. Pigment Blue 15:3, C. I. Pigment Blue 15:4, C. I. Pigment Blue 60, C. I. Pigment Blue 62, and C. I. Pigment Blue 66.

The magenta colorant can be exemplified by condensed azo compounds, diketopyrrolopyrrole compounds, anthraquinone compounds, quinacridone compounds, basic dye lake compounds, naphthol compounds, benzimidazolone compounds, thioindigo compounds, and perylene compounds, and can be specifically exemplified by the following: C. I. Pigment Red 2, C. I. Pigment Red 3, C. I. Pigment Red 5, C. I. Pigment Red 6, C. I. Pigment Red 7, C. I. Pigment Violet 19, C. I. Pigment Red 23, C. I. Pigment Red 48:2, C. I. Pigment Red 48:3, C. I. Pigment Red 48:4, C. I. Pigment Red 57:1, C. I. Pigment Red 81:1, C. I. Pigment Red 122, C. I. Pigment Red 144, C. I. Pigment Red 146, C. I. Pigment Red 150, C. I. Pigment Red 166, C. I. Pigment Red 169, C. I. Pigment Red 177, C. I. Pigment Red 184, C. I. Pigment Red 185, C. I. Pigment Red 202, C. I. Pigment Red 206, C. I. Pigment Red 220, C. I. Pigment Red 221, and C. I. Pigment Red 254.

The yellow colorant can be exemplified by condensed azo compounds, isoindolinone compounds, anthraquinone compounds, azo metal complexes, methine compounds, and allylamide compounds and can be specifically exemplified by the following: C. I. Pigment Yellow 12, C. I. Pigment Yellow 13, C. I. Pigment Yellow 14, C. I. Pigment Yellow 15, C. I. Pigment Yellow 17, C. I. Pigment Yellow 62, C. I. Pigment Yellow 74, C. I. Pigment Yellow 83, C. I. Pigment Yellow 93, C. I. Pigment Yellow 94, C. I. Pigment Yellow 95, C. I. Pigment Yellow 97, C. I. Pigment Yellow 109, C. I. Pigment Yellow 110, C. I. Pigment Yellow 111, C. I. Pigment Yellow 120, C. I. Pigment Yellow 127, C. I. Pigment Yellow 128, C. I. Pigment Yellow 129, C. I. Pigment Yellow 147, C. I. Pigment Yellow 151, C. I. Pigment Yellow 154, C. I. Pigment Yellow 155, C. I. Pigment Yellow 168, C. I. Pigment Yellow 174, C. I. Pigment Yellow 175, C. I. Pigment Yellow 176, C. I. Pigment Yellow 180, C. I. Pigment Yellow 181, C. I. Pigment Yellow 185, C. I. Pigment Yellow 191, and C. I. Pigment Yellow 194.

The black colorant can be exemplified by carbon black and by black colorants provided by color mixing using the yellow, magenta, and cyan colorants described above to give a black color.

These colorants can be used individually or in mixture and can be used in the form of a solid solution. The colorant used in the present invention should be selected considering the hue angle, chroma, lightness, lightfastness, and OHP transparency and the dispersibility in the toner particle.

The colorant is preferably used at from at least 1.0 mass parts to not more than 20.0 mass parts per 100.0 mass parts of the binder resin.

When the toner particle is obtained using a suspension polymerization method, considering the polymerization inhibiting action that colorants have and their aqueous phase migration behavior, a colorant is preferably used that has been subjected to a hydrophobic treatment with a substance that does not inhibit the polymerization. In a preferred method for subjecting a dye to a hydrophobic treatment, the polymerizable monomer is polymerized in advance in the presence of the dye to obtain a colored polymer and the thusly obtained colored polymer is added to the polymerizable monomer composition.

With a carbon black, a hydrophobic treatment may be carried out just as for a dye, supra, but in addition the treatment may be performed with a substance (a polyorganosiloxane) that reacts with the surface functional groups on the carbon black.

A charge control agent or a charge control resin may be used in the present invention.

A known charge control agent may be used for this charge control agent, while in particular a charge control agent is preferred that supports a fast triboelectric charging speed and that can stably maintain a constant or prescribed triboelectric charge quantity. Moreover, when the toner particle is to be produced by a suspension polymerization method, a charge control agent is particularly preferred that exhibits little inhibitory effect on the polymerization and that is substantially not soluble in the aqueous medium.

Charge control agents include those that control the toner to a negative chargeability and those that control the toner to a positive chargeability. Charge control agents that control the toner to a negative chargeability can be exemplified by the following: monoazo metal compounds; acetylacetone metal compounds; metal compounds of aromatic hydroxycarboxylic acids, aromatic dicarboxylic acids, hydroxycarboxylic acids, and dicarboxylic acids; aromatic hydroxycarboxylic acids, aromatic monocarboxylic acids, and aromatic polycarboxylic acids and their metal salts, anhydrides, and esters; phenol derivatives such as bisphenol; urea derivatives; metal-containing salicylic acid-type compounds; metal-containing naphthoic acid-type compounds; boron compounds; quaternary ammonium salts; calixarene; and charge control resins.

Charge control agents that control the toner to a positive chargeability can be exemplified by the following: guanidine compounds; imidazole compounds; quaternary ammonium salts such as tributylbenzylammonium-1-hydroxy-4-naphthosulfonic acid salt and tetrabutylammonium tetrafluoroborate and the analogous onium salts, such as the phosphonium salts, and their lake pigments; triphenylmethane dyes and their lake pigments (the laking agent can be exemplified by phosphotungstic acid, phosphomolybdic acid, phosphotungstomolybdic acid, tannic acid, lauric acid, gallic acid, ferricyanide, and ferrocyanide); metal salts of higher fatty acids; and charge control resins.

A single one of these charge control agents or charge control resins may be added, or combinations of two or more may be added.

Among these charge control agents, metal-containing salicylic acid-type compounds are preferred and metal-containing salicylic acid-type compounds in which the metal is aluminum or zirconium are preferred in particular.

The amount of addition of the charge control agent or charge control resin, expressed per 100.0 mass parts of the binder resin, is preferably from at least 0.01 mass parts to not more than 20.0 mass parts and is more preferably from at least 0.5 mass parts to not more than 10.0 mass parts.

On the other hand, a polymer or copolymer that has a sulfonic acid group, sulfonate salt group, or sulfonate ester group may be used as the charge control resin. In particular, a polymer having a sulfonic acid group, sulfonate salt group, or sulfonate ester group preferably contains at least 2 mass % and more preferably at least 5 mass %, expressed as the copolymerization ratio, of a sulfonic acid group-containing acrylamide-type monomer or sulfonic acid group-containing methacrylamide-type monomer.

The charge control resin preferably has a glass transition temperature (Tg) of from at least 35° C. to not more than 90° C., a peak molecular weight (Mp) of from at least 10,000 to not more than 30,000, and a weight-average molecular weight (Mw) of from at least 25,000 to not more than 50,000. The use of such a charge control resin can contribute to favorable triboelectric charging characteristics without affecting the thermal characteristics required of toner particles. Moreover, because the charge control resin contains a sulfonic acid group, for example, the dispersity of the colorant and the dispersibility of the charge control resin itself in the polymerizable monomer composition are improved, which can bring about additional improvements in the tinting strength, transparency, and triboelectric charging characteristics.

The polymerization initiator can be exemplified by organoperoxide-type initiators and azo-type polymerization initiators. The organoperoxide-type initiator can be exemplified by benzoyl peroxide, lauroyl peroxide, di-α-cumyl peroxide, 2,5-dimethyl-2,5-bis(benzoylperoxy)hexane, bis(4-t-butylcyclohexyl) peroxydicarbonate, 1,1-bis(t-butylperoxy)cyclododecane, t-butyl peroxymaleate, bis(t-butylperoxy) isophthalate, methyl ethyl ketone peroxide, tert-butylperoxy 2-ethylhexanoate, diisopropyl peroxycarbonate, cumene hydroperoxide, 2,4-dichlorobenzoyl peroxide, and tert-butyl peroxypivalate.

The azo-type polymerization initiator can be exemplified by 2,2'-azobis(2,4-dimethylvaleronitrile), 2,2'-azobisisobutyronitrile, 1,1'-azobis(cyclohexane-1-carbonitrile), 2,2'-azobis-4-methoxy-2,4-dimethylvaleronitrile, azobismethylbutyronitrile, and 2,2'-azobis(methyl isobutyrate).

A redox initiator, which is the combination of an oxidizing substance and a reducing substance, may also be used as the polymerization initiator. The oxidizing substance can be exemplified by inorganic peroxides such as hydrogen peroxide and persulfate salts (sodium salt, potassium salt, and ammonium salt) and by oxidizing metal salts such as cerium (IV) salts. The reducing substance can be exemplified by reducing metal salts (iron(II) salts, copper(I) salts, and chromium(III) salts); ammonia; lower amines (amines having about from at least 1 to not more than 6 carbons, such as methylamine and ethylamine); amino compounds such as hydroxylamine; reducing sulfur compounds such as sodium thiosulfate, sodium hydrosulfite, sodium bisulfite, sodium sulfite, and sodium formaldehyde sulfoxylate; lower alcohols (from at least 1 to not more than 6 carbons); ascorbic acid and its salts; and lower aldehydes (from at least 1 to not more than 6 carbons).

The polymerization initiator is selected with reference to its 10-hour half-life temperature, and a single polymerization initiator or a mixture of polymerization initiators may be used. The amount of addition of the polymerization initiator will vary with the desired degree of polymerization, but it is generally added at from at least 0.5 mass parts to not more than 20.0 mass parts per 100.0 mass parts of the polymerizable monomer.

A known chain transfer agent may also be added in order to control the degree of polymerization, and a polymerization inhibitor may also be added.

Various crosslinking agents may also be used when the polymerizable monomer is polymerized. The crosslinking agent can be exemplified by polyfunctional compounds such as divinylbenzene, 4,4'-divinylbiphenyl, ethylene glycol diacrylate, ethylene glycol dimethacrylate, diethylene glycol diacrylate, diethylene glycol dimethacrylate, glycidyl acrylate, glycidyl methacrylate, trimethylolpropane triacrylate, and trimethylolpropane trimethacrylate.

Known inorganic compound dispersion stabilizers and known organic compound dispersion stabilizers can be used as the dispersion stabilizer that is used in the preparation of the aqueous medium. The inorganic compound dispersion stabilizers can be exemplified by tricalcium phosphate, magnesium phosphate, aluminum phosphate, zinc phosphate, calcium carbonate, magnesium carbonate, calcium hydroxide, magnesium hydroxide, aluminum hydroxide, calcium metasilicate, calcium sulfate, barium sulfate, bentonite, silica, and alumina. The organic compound dispersion stabilizers, on the other hand, can be exemplified by polyvinyl alcohol, gelatin, methyl cellulose, methyl hydroxypropyl cellulose, ethyl cellulose, the sodium salt of carboxymethyl cellulose, polyacrylic acid and its salts, and starches. The amount of use of these dispersion stabilizers is preferably from at least 0.2 mass parts to not more 20.0 mass parts per 100.0 mass parts of the polymerizable monomer.

Among these dispersion stabilizers, when an inorganic compound dispersion stabilizer is used, a commercially available inorganic compound dispersion stabilizer may be used as such, but the inorganic compound may also be generated in the aqueous medium in order to obtain a dispersion stabilizer with a finer particle diameter. For example, in the case of tricalcium phosphate, it can be obtained by mixing an aqueous sodium phosphate solution with an aqueous calcium chloride solution under high-speed stirring.

An external additive for imparting various properties to the toner may be externally added to the toner particle. An external additive for improving toner flowability can be exemplified by finely divided inorganic particles such as finely divided silica particles, finely divided titanium oxide particles, and their finely divided composite oxide particles. Finely divided silica particles and finely divided titanium oxide particles are preferred among the finely divided inorganic particles.

The toner of the present invention can be obtained, for example, by externally mixing finely divided inorganic particles with the toner particles to induce the former's attachment to the toner particle surface. A known method may be used for the method of externally adding the finely divided inorganic particles. An example here is a method that performs a mixing process using a Henschel mixer (Mitsui Miike Chemical Engineering Machinery Co., Ltd.).

The finely divided silica particles can be exemplified by dry silica and fumed silica, which are produced by the vapor-phase oxidation of a silicon halide, and by wet silica, which is produced from water glass. Dry silica, which has little silanol group at the surface and within the finely divided silica particles and which has little $Na_2O$ and $SO_3^{2-}$, is preferred for the finely divided inorganic particles. In addition, the dry silica may be a finely divided composite particle of silica and another metal oxide, as provided by using another metal halide compound, such as aluminum chloride or titanium chloride, in combination with the silicon halide compound in the production process.

The triboelectric charge quantity for the toner can be adjusted, the environmental stability can be improved, and the flowability at high temperature and high humidity can be improved by subjecting the surface of the finely divided inorganic particles to a hydrophobic treatment with a treatment agent, and as a result the use of hydrophobically treated finely divided inorganic particles is preferred. When the finely divided inorganic particles externally added to the toner are hygroscopic, the triboelectric charge quantity of the toner and its flowability are reduced and a reduction in the developing performance and transferability is readily produced.

The treatment agent for executing the hydrophobic treatment on the finely divided inorganic particles can be exemplified by unmodified silicone varnishes, variously modified silicone varnishes, unmodified silicone oils, variously modified silicone oils, silane compounds, silane coupling agents, other organosilicon compounds, and organotitanium compounds. Silicone oils are preferred among the preceding. A single one of these treatment agents may be used or combinations of these treatment agents may be used.

The total amount of addition of the finely divided inorganic particles, expressed per 100.0 mass parts of the toner particles, is preferably from at least 1.0 mass parts to not more than 5.0 mass parts and is more preferably from at least 1.0 mass parts to not more than 2.5 mass parts. Viewed from the standpoint of toner durability, the external additive preferably has a particle diameter that is not more than one-tenth of the average particle diameter of the toner particle.

The methods for measuring the various properties related to the present invention are described in the following.

<Method of Calculating the SP Value>

The SP value was calculated in the present invention using equation (3) according to Fedors. Here, for the values of Δei and Δvi refer to "Energies of Vaporization and Molar Volumes (25° C.) of Atoms and Atomic Groups" in Tables 3 to 9 of "Basic Coating Science" (pp. 54-57, 1986 (Maki Shoten Publishing)).

$$\delta i=[Ev/V]^{(1/2)}=[\Delta ei/\Delta vi]^{(1/2)} \quad \text{Equation (3):}$$

Ev: energy of vaporization

V: molar volume

Δei: energy of vaporization of the atoms or atomic groups of component i

Δvi: molar volume of the atoms or atomic groups of component i

For example, hexanediol is built of (—OH)×2+(—$CH_2$—)×6 atomic groups, and its calculated SP value is determined from the following formula.

$$\delta i=[\Delta ei/\Delta vi]^{(1/2)}=[\{(5220)\times 2+(1180)\times 6\}/\{(13)\times 2+(16.1)\times 6\}]^{(1/2)}$$

The SP value (δi) then evaluates to 11.95.

<Method for Measuring the Molecular Weight>

The weight-average molecular weight (Mw) and the number-average molecular weight (Mn) of the block polymer are measured as described below using gel permeation chromatography (GPC).

First, the block polymer is dissolved in tetrahydrofuran (THF) at room temperature. The resulting solution is filtered across a "MyShoriDisk" (Tosoh Corporation) solvent-resistant membrane filter having a pore diameter of 0.2 μm to obtain a sample solution. This sample solution is adjusted to bring the concentration of the THF-soluble component to 0.8 mass %. The measurement is carried out under the following conditions using this sample solution.

instrument: "HLC-8220GPC" high-performance GPC instrument (Tosoh Corporation)

column: 2×LF-604 (Showa Denko Kabushiki Kaisha) eluent: THF flow rate: 0.6 mL/minute oven temperature: 40° C.

sample injection amount: 0.020 mL

The molecular weight of the sample is determined using a molecular weight calibration curve constructed using standard polystyrene resins (for example, trade name: "TSK Standard Polystyrene F-850, F-450, F-288, F-128, F-80, F-40, F-20, F-10, F-4, F-2, F-1, A-5000, A-2500, A-1000, A-500", from Tosoh Corporation).

The measurement of the molecular weight of the vinyl polymer segment of the block polymer is carried out after hydrolysis of the polyester segment of the block polymer.

The specific method is as follows. 5 mL of dioxane and 1 mL of a 10 mass % aqueous potassium hydroxide solution are added to 30 mg of the block polymer and the polyester segment is hydrolyzed by shaking for 6 hours at a temperature of 70° C. The solution is then dried to prepare a sample for measurement of the molecular weight of the vinyl polymer segment. The ensuing process is carried out as for the block polymer.

<Method for Measuring the Mass Ratio Between the Polyester Segment and the Vinyl Polymer Segment in the Block Polymer (the C/A Ratio)>

The mass ratio between the polyester segment and the vinyl polymer segment in the block polymer (the C/A ratio) was measured using nuclear magnetic resonance spectroscopy ($^1$H-NMR) [400 MHz, $CDCl_3$, room temperature (25° C.)].

measurement instrumentation: JNM-EX400 FT-NMR instrument (JEOL Ltd.)

measurement frequency: 400 MHz pulse condition: 5.0 μs frequency range: 10500 Hz number of integrations: 64

The mass ratio between the polyester segment and the vinyl polymer segment (the C/A ratio) was calculated from the integration values in the obtained spectrum.

<The Method for Measuring the Melting Point>

The melting point (Tm) of the block polymer is measured based on ASTM D 3418-82 using a "Q1000" differential scanning calorimeter (TA Instruments).

The melting points of indium and zinc are used for temperature correction in the instrument detection section, and the heat of fusion of indium is used for correction of the amount of heat.

Specifically, 5 mg of the block polymer is accurately weighed out and is introduced into the aluminum pan, and, using an empty aluminum pan as the reference, a measurement is run at a temperature raising rate of 10° C./minute in the measurement temperature range from 30° C. to 200° C. The measurement is run by raising up to 200° C., then cooling to 30° C., and then raising up again. The melting point (Tm) according to the DSC measurement of the block polymer is taken to be the maximum endothermic peak in the DSC curve in this second temperature raising process in the temperature range from 30° C. to 200° C.

<Separation of the Styrene-Acrylic Resin and Block Polymer from the Toner>

The following method may be used to separate the styrene-acrylic resin and block polymer from the toner. Separation is carried out by the following method, and structural determinations are carried out and the various properties are determined, such as calculation of the SP value.

(Separation of the Binder Resin and Wax from the Toner by Preparative Gel Permeation Chromatography (GPC))

The toner is dissolved in tetrahydrofuran (THF) and the solvent is distilled from the obtained soluble matter under reduced pressure to obtain the tetrahydrofuran (THF)-soluble component of the toner.

This tetrahydrofuran (THF)-soluble component of the toner is dissolved in chloroform to prepare a sample solution having a concentration of 25 mg/mL.

3.5 mL of the obtained sample solution is injected into the instrument indicated below and a low-molecular weight component deriving from the wax and having a molecular weight of less than 2,000 is fractionated under the following conditions from a high-molecular weight component deriving from the resin and having a molecular weight of at least 2,000.

preparative GPC instrument: Preparative HPLC Model LC-980 from Japan Analytical Industry Co., Ltd.

preparative column: JAIGEL 3H, JAIGEL 5H (Japan Analytical Industry Co., Ltd.)

eluent: chloroform flow rate: 3.5 mL/minute

After the high-molecular weight component deriving from the resin has been fractionated, the solvent is distilled off under reduced pressure and drying is carried out for 24 hours under reduced pressure in a 90° C. atmosphere. This procedure is repeated until about 100 mg of the resin component is obtained.

(Separation of the Styrene-Acrylic Resin and Block Polymer>

500 mL of acetone is added to 100 mg of the resin provided by the procedure indicated above and complete dissolution is carried out by heating to 70° C. This is followed by gradual cooling to 25° C. to recrystallize the block polymer. The block polymer is suction filtered to effect separation into the crystalline block polymer and a filtrate.

The separated filtrate is then gradually added to 500 mL of methanol in order to reprecipitate the styrene-acrylic resin. The styrene-acrylic resin is subsequently recovered with a suction filter.

The obtained styrene-acrylic resin and block polymer are dried under reduced pressure for 24 hours at 40° C.

<Determination of the Structure of the Styrene-Acrylic Resin and the Block Polymer>

The structure of the styrene-acrylic resin and the block polymer is determined using nuclear magnetic resonance spectroscopy ($^1$H-NMR) [400 MHz, $CDCl_3$, room temperature (25° C.)]

measurement instrument: JNM-EX400 FT-NMR instrument (JEOL Ltd.)

measurement frequency: 400 MHz pulse condition: 5.0 μs frequency range: 10500 Hz
number of integrations: 64

<Measurement of the Content of the Substructure Originating with Monomer (b) in the Polyester Segment>

The content of the substructure originating with monomer (b) in the polyester segment of the block polymer is calculated from the integration values in the nuclear magnetic resonance ($^1$H-NMR) spectrum of the block polymer.
measurement instrument: JNM-EX400 FT-NMR instrument (JEOL Ltd.)
measurement frequency: 400 MHz
pulse condition: 5.0 μs
frequency range: 10500 Hz
number of integrations: 64

<Measurement of the Content of the Block Polymer in the Binder Resin from the Toner>

The content of the block polymer is calculated from the integration values in the nuclear magnetic resonance ($^1$H-NMR) spectrum of the toner based on the individual nuclear magnetic resonance ($^1$H-NMR) spectra for the styrene-acrylic resin and the block polymer.
measurement instrument: JNM-EX400 FT-NMR instrument (JEOL Ltd.)
measurement frequency: 400 MHz
pulse condition: 5.0 μs
frequency range: 10500 Hz
number of integrations: 64

EXAMPLES

The present invention is more specifically described through the examples provided below. However, the present invention is not limited to or by these examples. Unless specifically indicated otherwise, the number of parts and % used in the examples and comparative example are in all instances on a mass basis.

<Production of Block Polymer 1>

100.0 mass parts of 1,10-decanedicarboxylic acid and 44.5 mass parts of 1,6-hexanediol as monomers selected from monomer group A, 17.6 mass parts of 1,12-dodecanediol as monomer selected from monomer group B, and 0.7 mass parts of titanium(IV) isopropoxide as an esterification catalyst were added to a reactor fitted with a stirrer, thermometer, nitrogen introduction tube, water separation tube, and pressure-reduction apparatus and were reacted for 5 hours at 160° C. under a nitrogen atmosphere. After this, a reaction was carried out for 4 hours at 180° C. and additionally at 180° C. and 1 hPa until the desired molecular weight was reached, to obtain a polyester (1). The weight-average molecular weight (Mw) of the polyester (1) was 19,000.

100.0 mass parts of polyester (1) and 400.0 mass parts of dry chloroform were then added to a reactor fitted with a stirrer, thermometer, and nitrogen introduction tube. After complete dissolution, 18.0 mass parts of triethylamine was added and 34.0 mass parts of 2-bromoisobutyryl bromide was gradually added with ice cooling. This was followed by stirring for 24 hours at room temperature (25° C.)

After reprecipitation with 800.0 mass parts of methanol, filtration and drying were carried out to obtain a polyester (2).

Then, 100.0 mass parts of the thusly obtained polyester (2), 300.0 mass parts of styrene as monomer for producing the vinyl polymer segment, 4.0 mass parts of copper(I) bromide, and 9.5 mass parts of pentamethyldiethylenetriamine were added to a reactor fitted with a stirrer, thermometer, and nitrogen introduction tube and a polymerization reaction was run at a temperature of 100° C. while stirring. The reaction was stopped once the desired molecular weight was reached, followed by reprecipitation with 250.0 mass parts of methanol, filtration, and drying to obtain a block polymer 1 having a polyester segment and a vinyl polymer segment. The properties of the obtained block polymer 1 are given in Table 3.

<Production of Block Polymers 2 to 17>

Block polymers 2 to 17 were obtained proceeding as in the Production of Block Polymer 1, but changing to the starting materials as shown in Table 1. The properties of the obtained block polymers 2 to 17 are shown in Table 3.

<Production of Block Polymer 18>

50.0 mass parts of xylene was heated under reflux at 140° C. under a nitrogen atmosphere in a reactor fitted with a stirrer, thermometer, nitrogen introduction tube, and pressure-reduction apparatus. To this was added a mixture of 100.0 mass parts of styrene and 8.6 mass parts of 2,2'-azobis (methyl isobutyrate) dropwise over 3 hours, and after the completion of the dropwise addition the reaction was run for an additional 3 hours. This was followed by distillative removal of the xylene and residual styrene at 160° C. and 1 hPa to obtain a vinyl polymer (1).

100.0 mass parts of the thusly obtained vinyl polymer (1), 50.0 parts of xylene as organic solvent, 121.9 mass parts of 1,10-decanedicarboxylic acid and 59.3 mass parts of 1,6-hexanediol as monomers selected from monomer group A, 22.5 mass parts of 1,12-dodecanediol as monomer selected from monomer group B, and 0.7 mass parts of titanium(IV) isopropoxide as an esterification catalyst were then added to a reactor fitted with a stirrer, thermometer, nitrogen introduction tube, water separation tube, and pressure-reduction apparatus, and a reaction was run for 5 hours at 160° C. under a nitrogen atmosphere. This was followed by reaction for 4 hours at 180° C. and further reaction at 180° C. and 1 hPa until the desired molecular weight was reached to obtain a block polymer 18.

<Production of Block Polymers 19 to 35>

Block polymers 19 to 35 were obtained proceeding as in the Production of Block Polymer 18, but changing to the starting materials as shown in Table 2. The properties of the obtained block polymers 19 to 35 are shown in Table 3.

<Production of Comparative Polymers 1 and 2>

Comparative polymers 1 and 2 were obtained proceeding as in the Production of Block Polymer 1, but changing to the starting materials as shown in Table 1. The properties of the obtained comparative polymers 1 and 2 are shown in Table 3.

<Production of Comparative Polymer 3>

100.0 mass parts of fumaric acid, 101.0 mass parts of 1,6-hexanediol, 0.5 mass parts of dibutyltin oxide, and 0.1 mass parts of hydroquinone were added to a reactor fitted with a stirrer, thermometer, nitrogen introduction tube, water separation tube, and pressure-reduction apparatus and were reacted for 5 hours at 160° C. under a nitrogen atmosphere. This was followed by reaction for 1 hour at 200° C. and further reaction at 200° C. and 1 hPa until the desired molecular weight was reached, thereby obtaining comparative polymer 3. The weight-average molecular weight (Mw) of the obtained comparative polymer 3 was 18,000.

TABLE 1

| | polyester segment | | | | vinyl polymer segment | |
|---|---|---|---|---|---|---|
| | monomer group A | | monomer group B | | | |
| | monomer | mass parts | monomer | mass parts | monomer | mass parts |
| block polymer 1 | 1,10-decanedicarboxylic acid<br>1,6-hexanediol | 100.0<br>44.5 | 1,12-dodecanediol | 17.6 | styrene | 300.0 |
| block polymer 2 | sebacic acid<br>1,6-hexanediol | 100.0<br>27.3 | 1,12-dodecanediol | 61.4 | styrene | 300.0 |
| block polymer 3 | 1,10-decanedicarboxylic acid<br>1,6-hexanediol | 100.0<br>54.7 | 1,12-dodecanediol | 1.9 | styrene | 300.0 |
| block polymer 4 | sebacic acid<br>1,9-nonanediol | 100.0<br>68.7 | 1,12-dodecanediol | 20.7 | styrene | 300.0 |
| block polymer 5 | sebacic acid<br>ethylene glycol | 100.0<br>20.5 | 1,12-dodecanediol | 45.4 | styrene | 300.0 |
| block polymer 6 | adipic acid<br>1,10-decanediol | 100.0<br>103.4 | 1,12-dodecanediol | 25.8 | styrene | 300.0 |
| block polymer 7 | adipic acid<br>1,10-decanediol | 100.0<br>103.4 | 1,12-dodecanediol | 25.8 | styrene<br>n-butyl acrylate | 255.0<br>45.0 |
| block polymer 8 | oxalic acid<br>1,10-decanediol | 100.0<br>103.2 | 1,12-dodecanediol | 112.4 | styrene | 300.0 |
| block polymer 9 | 1,10-decanedicarboxylic acid<br>1,6-hexanediol | 100.0<br>43.2 | 15-hydroxy<br>pentadecanoic acid | 41.7 | styrene | 300.0 |
| block polymer 10 | 1,10-decanedicarboxylic acid<br>1,6-hexanediol | 100.0<br>54.9 | 1,22-docosane<br>dicarboxylic acid | 25.0 | styrene | 300.0 |
| block polymer 11 | 1,10-decanedicarboxylic acid<br>1,6-hexanediol | 100.0<br>44.5 | 1,12-dodecanediol | 17.6 | styrene | 300.0 |
| block polymer 12 | 1,10-decanedicarboxylic acid<br>1,6-hexanediol | 100.0<br>44.5 | 1,12-dodecanediol | 17.6 | styrene | 300.0 |
| block polymer 13 | 1,10-decanedicarboxylic acid<br>1,6-hexanediol | 100.0<br>44.5 | 1,12-dodecanediol | 17.6 | styrene | 300.0 |
| block polymer 14 | 1,10-decanedicarboxylic acid<br>1,6-hexanediol | 100.0<br>44.5 | 1,12-dodecanediol | 17.6 | styrene | 300.0 |
| block polymer 15 | sebacic acid<br>ethylene glycol | 100.0<br>30.7 | 1,12-dodecanediol | 6.7 | styrene | 300.0 |
| block polymer 16 | 1,10-decanedicarboxylic acid<br>1,5-pentanediol | 100.0<br>39.2 | 1,12-dodecanediol | 17.6 | styrene | 300.0 |
| block polymer 17 | 1,10-decanedicarboxylic acid<br>ethylene glycol | 100.0<br>19.8 | 1,12-dodecanediol | 29.3 | styrene | 300.0 |
| comparative polymer 1 | 1,10-decanedicarboxylic acid<br>1,5-pentanediol | 100.0<br>48.2 | none | | styrene | 300.0 |
| comparative polymer 2 | 1,10-decanedicarboxylic acid<br>1,10-decanediol | 100.0<br>17.7 | 15-hydroxy<br>pentadecanoic acid | 93.5 | styrene | 300.0 |

40

TABLE 2

| | polyester segment | | | | vinyl polymer segment | |
|---|---|---|---|---|---|---|
| | monomer group A | | monomer group B | | | |
| | monomer | mass parts | monomer | mass parts | polymerization initiator | mass parts |
| block polymer 18 | 1,10-decanedicarboxylic acid<br>1,6-hexanediol | 121.9<br>59.3 | 1,12-dodecanediol | 22.5 | 2,2'-azobis<br>(methyl isobutyrate) | 8.6 |
| block polymer 19 | sebacic acid<br>1,10-decanediol | 107.1<br>87.4 | 1,12-dodecanediol | 18.0 | 2,2'-azobis<br>(methyl isobutyrate) | 8.6 |
| block polymer 20 | 1,10-decanedicarboxylic acid<br>1,10-decanediol | 115.5<br>87.4 | 1,12-dodecanediol | 13.5 | 2,2'-azobis<br>(methyl isobutyrate) | 8.6 |
| block polymer 21 | 1,10-decanedicarboxylic acid<br>1,6-hexanediol | 106.6<br>55.3 | 1,11-undecane<br>dicarboxylic acid | 12.1 | 2,2'-azobis<br>(methyl isobutyrate) | 8.0 |
| block polymer 22 | 1,10-decanedicarboxylic acid<br>1,6-hexanediol | 104.2<br>53.5 | 1,15-pentadecane<br>dicarboxyic acid | 15.5 | 2,2'-azobis<br>(methyl isobutyrate) | 8.0 |
| block polymer 23 | 1,10-decanedicarboxylic acid<br>1,6-hexanediol | 101.8<br>52.2 | 1,20-eicosane<br>dicarboxylic acid | 18.8 | 2,2'-azobis<br>(methyl isobutyrate) | 8.0 |
| block polymer 24 | 1,10-decanedicarboxylic acid<br>1,6-hexanediol | 102.7<br>52.7 | 1,12-dodecanediol | 19.2 | 2,2'-azobis<br>(methyl isobutyrate) | 17.2 |
| block polymer 25 | 1,10-decanedicarboxylic acid<br>1,6-hexanediol | 93.4<br>47.9 | 1,12-dodecanediol | 18.9 | 2,2'-azobis<br>(methyl isobutyrate) | 22.4 |
| block polymer 26 | 1,10-decanedicarboxylic acid<br>1,6-hexanediol | 96.7<br>53.2 | 1,12-dodecanediol | 18.8 | 2,2'-azobis<br>(methyl isobutyrate) | 4.6 |
| block polymer 27 | 1,10-decanedicarboxylic acid<br>1,6-hexanediol | 101.8<br>47.6 | 1,12-dodecanediol | 18.9 | 2,2'-azobis<br>(methyl isobutyrate) | 4.0 |

TABLE 2-continued

| | polyester segment | | | | vinyl polymer segment | |
|---|---|---|---|---|---|---|
| | monomer group A | | monomer group B | | | |
| | monomer | mass parts | monomer | mass parts | polymerization initiator | mass parts |
| block polymer 28 | 1,10-decanedicarboxylic acid<br>1,6-hexanediol | 102.7<br>49.4 | 1,12-dodecanediol | 20.3 | 2,2'-azobis (methyl isobutyrate) | 8.6 |
| block polymer 29 | 1,10-decanedicarboxylic acid<br>1,6-hexanediol | 102.7<br>49.4 | 1,12-dodecanediol | 20.3 | 2,2'-azobis (methyl isobutyrate) | 8.6 |
| block polymer 30 | 1,10-decanedicarboxylic acid<br>1,6-hexanediol | 101.0<br>50.5 | 1,12-dodecanediol | 20.3 | 2,2'-azobis (methyl isobutyrate) | 8.6 |
| block polymer 31 | 1,10-decanedicarboxylic acid<br>1,6-hexanediol | 101.0<br>50.5 | 1,12-dodecanediol | 20.3 | 2,2'-azobis (methyl isobutyrate) | 8.6 |
| block polymer 32 | sebacic acid<br>1,10-decanediol | 84.5<br>68.0 | 1,12-dodecanediol | 19.2 | 2,2'-azobis (methyl isobutyrate) | 8.0 |
| block polymer 33 | sebacic acid<br>ethylene glycol | 78.9<br>15.8 | 1,12-dodecanediol | 34.7 | 2,2'-azobis (methyl isobutyrate) | 8.0 |
| block polymer 34 | 1,10-decanedicarboxylic acid<br>1,6-hexanediol | 102.7<br>49.4 | 1,12-dodecanediol | 20.3 | 2,2'-azobis (methyl isobutyrate) | 8.6 |
| block polymer 35 | 1,10-decanedicarboxylic acid<br>1,6-hexanediol | 102.7<br>49.4 | 1,12-dodecanediol | 20.3 | 2,2'-azobis (methyl isobutyrate) | 8.6 |

TABLE 3

| | | | block polymer | | |
|---|---|---|---|---|---|
| polymer | monomer (b) content (mol %) | vinyl polymer segment (Mw) | C/A ratio (polyester segment/vinyl polymer segment) | Mw | melting point [° C.] |
| block polymer 1 | 9.7 | 7500 | 60/40 | 33000 | 64 |
| block polymer 2 | 29.5 | 7500 | 55/45 | 33000 | 60 |
| block polymer 3 | 1.0 | 7000 | 65/35 | 34000 | 64 |
| block polymer 4 | 10.0 | 7500 | 55/45 | 33000 | 62 |
| block polymer 5 | 21.2 | 7500 | 55/45 | 32000 | 64 |
| block polymer 6 | 9.1 | 7000 | 60/40 | 33000 | 65 |
| block polymer 7 | 9.1 | 9000 | 52/48 | 33000 | 65 |
| block polymer 8 | 24.2 | 7500 | 60/40 | 33000 | 71 |
| block polymer 9 | 15.4 | 7500 | 60/40 | 32000 | 60 |
| block polymer 10 | 6.1 | 5000 | 70/30 | 30000 | 60 |
| block polymer 11 | 9.7 | 4000 | 80/20 | 28000 | 64 |
| block polymer 12 | 9.7 | 3500 | 90/10 | 35000 | 64 |
| block polymer 13 | 9.7 | 11000 | 40/60 | 38000 | 61 |
| block polymer 14 | 9.7 | 12000 | 35/65 | 40000 | 60 |
| block polymer 15 | 3.2 | 7500 | 60/40 | 33000 | 63 |
| block polymer 16 | 9.7 | 7500 | 60/40 | 33000 | 52 |
| block polymer 17 | 16.1 | 7500 | 60/40 | 33000 | 81 |
| block polymer 18 | 9.7 | 7000 | 65/35 | 30000 | 64 |
| block polymer 19 | 8.0 | 7000 | 65/35 | 33000 | 68 |
| block polymer 20 | 6.0 | 7000 | 65/35 | 36000 | 72 |
| block polymer 21 | 6.1 | 7500 | 60/40 | 32000 | 64 |
| block polymer 22 | 6.1 | 7500 | 60/40 | 35000 | 64 |
| block polymer 23 | 6.1 | 7500 | 60/40 | 36000 | 64 |
| block polymer 24 | 9.7 | 3500 | 60/40 | 36000 | 64 |
| block polymer 25 | 9.7 | 2500 | 60/40 | 36000 | 64 |
| block polymer 26 | 9.7 | 13000 | 60/40 | 44000 | 64 |
| block polymer 27 | 9.7 | 15000 | 60/40 | 44000 | 64 |
| block polymer 28 | 9.7 | 7000 | 60/40 | 21000 | 63 |
| block polymer 29 | 9.7 | 7000 | 60/40 | 19000 | 62 |
| block polymer 30 | 9.7 | 7000 | 60/40 | 44000 | 65 |
| block polymer 31 | 9.7 | 7000 | 60/40 | 46000 | 65 |
| block polymer 32 | 10.0 | 7000 | 65/35 | 33000 | 68 |
| block polymer 33 | 21.2 | 7500 | 55/45 | 32000 | 64 |
| comparative polymer 1 | 0 | 7500 | 60/40 | 33000 | 54 |
| comparative polymer 2 | 40.0 | 7000 | 65/35 | 36000 | 81 |
| block polymer 34 | 9.7 | 7000 | 60/40 | 15000 | 62 |
| block polymer 35 | 9.7 | 7000 | 60/40 | 14000 | 62 |

<Production of Toner 1>

An aqueous medium was prepared by adding 9.0 mass parts of tricalcium phosphate to 1300.0 mass parts of deionized water heated to a temperature of 60° C. and stirring at a stirring rate of 15,000 rpm using a TK Homomixer (Tokushu Kika Kogyo Co., Ltd.).

A mixture was prepared by mixing the following binder resin materials with stirring at a stirring rate of 100 rpm using a propeller-type stirring device.

| | |
|---|---|
| styrene | 50.7 mass parts |
| n-butyl acrylate | 14.3 mass parts |
| block polymer 1 | 35.0 mass parts |
| To this solution was then added | |
| cyan colorant (C.I. Pigment Blue 15:3) | 6.5 mass parts |
| negative charging charge control agent (BONTRON E-88, from Orient Chemical Industries Co., Ltd.) | 0.5 mass parts |
| hydrocarbon wax (melting point = 78° C.) | 9.0 mass parts |
| negative charging charge control resin 1 (styrene/2-ethylhexyl acrylate/ 2-acrylamido--2-methylpropanesulfonic acid copolymer, acid value = 14.5 mg KOH/g, Tg = 83° C., Mw = 33,000) | 0.7 mass parts |
| polar resin (styrene/2-hydroxyethyl methacrylate/methacrylic acid/methyl methacrylate copolymer, acid value = 10 mg KOH/g, Tg = 80° C., Mw = 15,000) | 5.0 mass parts |

and the mixture was thereafter heated to a temperature of 65° C. followed by stirring at a stirring rate of 10,000 rpm with a TK Homomixer (Tokushu Kika Kogyo Co., Ltd.) to effect dissolution and dispersion and produce a polymerizable monomer composition.

This polymerizable monomer composition was introduced into the aforementioned aqueous medium and Perbutyl PV 6.0 mass parts (10-hour half-life temperature=54.6° C. (NOF Corporation)) was added as a polymerization initiator and granulation was carried out by stirring at a temperature of 70° C. for 20 minutes at a stirring rate of 15,000 rpm using a TK Homomixer.

After transfer to a propeller-type stirrer and while stirring at a stirring rate of 200 rpm, the styrene and n-butyl acrylate, which were the polymerizable monomers in the polymerizable monomer composition, were polymerized for 5 hours at a temperature of 85° C. to produce a toner particle-containing slurry. The slurry was cooled after the completion of the polymerization reaction. The pH was brought to 1.4 by the addition of hydrochloric acid to the cooled slurry and the calcium phosphate salt was dissolved by stirring for 1 hour.

Washing with water at 10-fold relative to the slurry was then performed followed by filtration and drying and subsequent adjustment of the particle diameter by classification to obtain toner particles. The toner particles contained 65.0 mass parts of a styrene-acrylic resin, 35.0 mass parts of the block polymer, 6.5 mass parts of the cyan colorant, 9.0 mass parts of the wax, 0.5 mass parts of the negative charging charge control agent, 0.7 mass parts of the negative charging charge control resin 1, and 5.0 mass parts of the polar resin.

A toner 1 was obtained by mixing 100.0 mass parts of these toner particles for 15 minutes using a Henschel mixer (Mitsui Miike Chemical Engineering Machinery Co., Ltd.) at a stirring rate of 3,000 rpm with 1.5 mass parts of an external additive in the form of hydrophobic finely divided silica particles (primary particle diameter: 7 nm, BET specific surface area: 130 $m^2/g$) provided by the treatment of finely divided silica particles with a dimethylsilicone oil at 20 mass % with reference to the finely divided silica particles. The properties of toner 1 are given in Table 4. Here, D1 is the number-average particle diameter and D4 is the weight-average particle diameter.

<Production of Toners 2 to 39 and 43 to 46>

Toners 2 to 39 and 43 to 46 were obtained proceeding as in the method of producing toner 1, with the exception that the starting materials and parts of addition were changed as shown in Table 4. The properties of toner 2 to 39 and 43 to 46 are given in Table 4.

TABLE 4

| | binder resin | | | | toner properties | | | |
|---|---|---|---|---|---|---|---|---|
| | block | | | | | | | |
| toner No. | polymer No. | mass parts | styrene-acrylic resin | mass parts | ΔSP value | D1 (μm) | D4 (μm) | Mw |
| 1 | 1 | 35.0 | styrene:n-butyl acrylate 78:22 | 65.0 | 0.18 | 4.8 | 5.8 | 28000 |
| 2 | 2 | 35.0 | styrene:n-butyl acrylate 78:22 | 65.0 | 0.20 | 4.7 | 5.8 | 29000 |
| 3 | 3 | 35.0 | styrene:n-butyl acrylate 78:22 | 65.0 | 0.13 | 4.8 | 5.8 | 36000 |
| 4 | 4 | 35.0 | styrene:n-butyl acrylate 78:22 | 65.0 | 0.21 | 4.3 | 5.7 | 31000 |
| 5 | 5 | 35.0 | styrene:n-butyl acrylate 78:22 | 65.0 | 0.00 | 4.7 | 5.9 | 29000 |
| 6 | 6 | 35.0 | styrene:n-butyl acrylate 78:22 | 65.0 | 0.03 | 4.5 | 5.7 | 33000 |
| 7 | 7 | 35.0 | styrene:n-butyl acrylate 78:22 | 65.0 | 0.03 | 4.3 | 5.7 | 29000 |
| 8 | 8 | 35.0 | styrene:n-butyl acrylate 78:22 | 65.0 | 0.24 | 4.8 | 5.8 | 28000 |
| 9 | 18 | 35.0 | styrene:n-butyl acrylate 78:22 | 65.0 | 0.18 | 4.3 | 6.1 | 34000 |
| 10 | 19 | 35.0 | styrene:n-butyl acrylate 78:22 | 65.0 | 0.25 | 4.7 | 5.9 | 34000 |
| 11 | 20 | 35.0 | styrene:n-butyl acrylate 78:22 | 65.0 | 0.33 | 4.8 | 5.8 | 33000 |
| 12 | 9 | 35.0 | styrene:n-butyl acrylate 78:22 | 65.0 | 0.13 | 5.0 | 6.3 | 28000 |
| 13 | 10 | 35.0 | styrene:n-butyl acrylate 78:22 | 65.0 | 0.10 | 4.3 | 5.7 | 31000 |
| 14 | 21 | 35.0 | styrene:n-butyl acrylate 78:22 | 65.0 | 0.24 | 4.8 | 5.8 | 36000 |
| 15 | 22 | 35.0 | styrene:n-butyl acrylate 78:22 | 65.0 | 0.27 | 4.7 | 5.7 | 31000 |
| 16 | 23 | 35.0 | styrene:n-butyl acrylate 78:22 | 65.0 | 0.29 | 4.8 | 5.8 | 36000 |
| 17 | 1 | 10.0 | styrene:n-butyl acrylate 78:22 | 90.0 | 0.18 | 4.7 | 5.7 | 31000 |
| 18 | 1 | 5.0 | styrene:n-butyl acrylate 78:22 | 95.0 | 0.18 | 4.3 | 5.8 | 28000 |
| 19 | 1 | 50.0 | styrene:n-butyl acrylate 78:22 | 50.0 | 0.18 | 4.7 | 5.7 | 31000 |
| 20 | 1 | 55.0 | styrene:n-butyl acrylate 78:22 | 45.0 | 0.18 | 4.8 | 5.8 | 36000 |
| 21 | 11 | 35.0 | styrene:n-butyl acrylate 78:22 | 65.0 | 0.18 | 4.7 | 5.8 | 34000 |
| 22 | 12 | 35.0 | styrene:n-butyl acrylate 78:22 | 65.0 | 0.18 | 4.3 | 5.8 | 28000 |
| 23 | 13 | 35.0 | styrene:n-butyl acrylate 78:22 | 65.0 | 0.18 | 4.7 | 5.7 | 34000 |
| 24 | 14 | 35.0 | styrene:n-butyl acrylate 78:22 | 65.0 | 0.18 | 4.9 | 5.8 | 36000 |
| 25 | 24 | 35.0 | styrene:n-butyl acrylate 78:22 | 65.0 | 0.18 | 4.3 | 5.7 | 33000 |
| 26 | 25 | 35.0 | styrene:n-butyl acrylate 78:22 | 65.0 | 0.18 | 4.3 | 5.7 | 28000 |
| 27 | 26 | 35.0 | styrene:n-butyl acrylate 78:22 | 65.0 | 0.18 | 4.9 | 5.9 | 31000 |
| 28 | 27 | 35.0 | styrene:n-butyl acrylate 78:22 | 65.0 | 0.18 | 4.7 | 5.9 | 28000 |
| 29 | 28 | 35.0 | styrene:n-butyl acrylate 78:22 | 65.0 | 0.18 | 4.9 | 5.9 | 36000 |
| 30 | 29 | 35.0 | styrene:n-butyl acrylate 78:22 | 65.0 | 0.18 | 4.3 | 5.7 | 31000 |
| 31 | 30 | 35.0 | styrene:n-butyl acrylate 78:22 | 65.0 | 0.18 | 4.7 | 5.6 | 28000 |
| 32 | 31 | 35.0 | styrene:n-butyl acrylate 78:22 | 65.0 | 0.18 | 4.8 | 5.9 | 28000 |
| 33 | 15 | 35.0 | styrene:n-butyl acrylate 78:22 | 65.0 | 0.32 | 4.3 | 5.5 | 28000 |
| 34 | 16 | 35.0 | styrene:n-butyl acrylate 78:22 | 65.0 | 0.14 | 4.7 | 5.8 | 34000 |
| 35 | 17 | 35.0 | styrene:n-butyl acrylate 78:22 | 65.0 | 0.06 | 4.9 | 5.8 | 36000 |
| 36 | 1 | 35.0 | styrene:n-propyl acrylate 74:26 | 65.0 | 0.23 | 4.3 | 5.6 | 34000 |
| 37 | 32 | 35.0 | styrene:n-propyl acrylate 74:26 | 65.0 | 0.38 | 4.7 | 5.5 | 28000 |
| 38 | 1 | 35.0 | styrene:t-butyl acrylate 28:72 | 65.0 | 0.14 | 4.9 | 5.9 | 33000 |
| 39 | 33 | 35.0 | styrene:t-butyl acrylate 28:72 | 65.0 | 0.32 | 4.9 | 5.8 | 36000 |
| 43 | 1 | 2.0 | styrene:n-butyl acrylate 78:22 | 98.0 | 0.18 | 4.2 | 5.7 | 28000 |
| 44 | 1 | 1.0 | styrene:n-butyl acrylate 78:22 | 99.0 | 0.18 | 4.2 | 5.6 | 28000 |
| 45 | 34 | 35.0 | styrene:n-butyl acrylate 78:22 | 65.0 | 0.18 | 4.2 | 5.7 | 31000 |
| 46 | 35 | 35.0 | styrene:n-butyl acrylate 78:22 | 65.0 | 0.18 | 4.2 | 5.7 | 30000 |

<Production of Toner 40>

| | |
|---|---|
| styrene-acrylic resin (copolymer of styrene:n-butyl acrylate = 80:20 (mass ratio)) (Mw = 30,000, Tg = 55° C.) | 65.0 mass parts |
| block polymer 1 | 35.0 mass parts |
| methyl ethyl ketone | 100.0 mass parts |
| ethyl acetate | 100.0 mass parts |
| hydrocarbon wax (melting point = 78° C.) | 9.0 mass parts |
| cyan colorant (C.I. Pigment Blue 15:3) | 6.5 mass parts |
| negative charging charge control resin 1 (styrene/2-ethylhexyl acrylate/2-acrylamido-2-methylpropanesulfonic acid copolymer, acid value = 14.5 mg KOH/g, Tg = 83° C., Mw = 33,000) | 1.0 mass parts |

These materials were dispersed for 3 hours using an attritor (Mitsui Mining & Smelting Co., Ltd.) to obtain a colorant-dispersed solution. On the other hand, an aqueous medium was prepared by adding 27.0 mass parts of calcium phosphate to 3000.0 mass parts of deionized water heated to a temperature of 60° C. and stirring at a stirring rate of 10,000 rpm using a TK Homomixer (Tokushu Kika Kogyo Co., Ltd.). The colorant-dispersed solution was introduced into the aqueous medium and the colorant particles were granulated by stirring for 15 minutes at a stirring rate of 12,000 rpm using a TK Homomixer under an $N_2$ atmosphere at a temperature of 65° C. After this, the TK Homomixer was replaced with an ordinary propeller stirrer and, while maintaining the stirring rate with the stirrer at 150 rpm, the internal temperature was raised to a temperature of 95° C. and the solvent was removed from the dispersion by holding for 3 hours, thus producing a dispersion of toner particles. Hydrochloric acid was added to the obtained toner particle dispersion to bring the pH to 1.4 and the calcium phosphate salt was dissolved by stirring for 1 hour. The dispersion was filtered and washed on a pressure filter to obtain a toner aggregate. This toner aggregate was subsequently pulverized and dried to obtain toner particles. The toner particles contained 65.0 mass parts of the styrene-acrylic resin, 35.0 mass parts of the block polymer, 6.5 mass parts of the cyan colorant, 9.0 mass parts of the wax, and 1.0 mass parts of the negative charging charge control resin 1. A toner 40 was obtained by mixing 100.0 mass parts of these toner particles for 15 minutes using a Henschel mixer (Mitsui Miike Chemical Engineering Machinery Co., Ltd.) at a stirring rate of 3,000 rpm with 1.5 mass parts of an external additive in the form of hydrophobic finely divided silica particles (primary particle diameter: 7 nm, BET specific surface area: 130 $m^2/g$) provided by the treatment of finely divided silica particles with a dimethylsilicone oil at 20 mass % with reference to the finely divided silica particles. Toner 40 exhibited the following: ΔSP value=0.18, D1=3.9 μm, and D4=6.3 μm.

<Production of Toner 41>

(Production of a Resin Particle Dispersion 1)

| | |
|---|---|
| styrene | 75.0 mass parts |
| n-butyl acrylate | 25.0 mass parts |

The preceding were mixed with dissolution; this was dispersed and emulsified in 120.0 mass parts of deionized water in which 1.5 mass parts of a nonionic surfactant (Sanyo Chemical Industries, Ltd.: Nonipol 400) and 2.2 mass parts of an anionic surfactant (Dai-ichi Kogyo Seiyaku Co., Ltd.: Neogen SC) were dissolved; and 1.5 mass parts of the polymerization initiator ammonium persulfate dissolved in 10.0 mass parts of deionized water was gradually introduced over 10 minutes while mixing. After nitrogen substitution, the contents were heated to a temperature of 70° C. while stirring and an emulsion polymerization was continued under these conditions for 4 hours to produce a resin particle dispersion 1 in which resin particles having an average particle diameter of 0.29 μm were dispersed.

(Production of a Resin Particle Dispersion 2)

A solution of block polymer 1 100.0 mass parts was dispersed and emulsified in 120 mass parts of deionized water in which 1.5 mass parts of a nonionic surfactant (Sanyo Chemical Industries, Ltd.: Nonipol 400) and 2.2 mass parts of an anionic surfactant (Dai-ichi Kogyo Seiyaku Co., Ltd.: Neogen SC) were dissolved. A resin particle dispersion 2 was produced in which resin particles having an average particle diameter of 0.36 μm were dispersed.

(Production of a Colorant Particle Dispersion)

| | |
|---|---|
| cyan colorant (C.I. Pigment Blue 15:3) | 20.0 mass parts |
| anionic surfactant (Dai-ichi Kogyo Seiyaku Co., Ltd.: Neogen SC) | 3.0 mass parts |
| deionized water | 78.0 mass parts |

The preceding were mixed and were dispersed using a sand grinder mill. When the particle size distribution in this colorant particle dispersion was measured using a particle distribution analyzer (LA-700 from Horiba, Ltd.), the average particle diameter of the colorant particles contained therein was 0.20 μm and coarse particles in excess of 1 μm were not observed.

(Production of a Wax Particle Dispersion)

| | |
|---|---|
| hydrocarbon wax (melting point = 78° C.) | 50.0 mass parts |
| anionic surfactant (Dai-ichi Kogyo Seiyaku Co., Ltd.: Neogen SC) | 7.0 mass parts |
| deionized water | 200.0 mass parts |

The preceding were heated to a temperature of 95° C.; dispersion was carried out using a homogenizer (IKA: Ultra-Turrax T50); and a dispersion treatment was then performed using a pressure-ejection homogenizer to produce a wax particle dispersion in which wax with an average particle size of 0.50 μm was dispersed.

(Production of a Charge Control Particle Dispersion)

| | |
|---|---|
| metal compound of a dialkylsalicylic acid (negative charging charge control agent, BONTRON E-84, from Orient Chemical Industries Co., Ltd.) | 5.0 mass parts |
| anionic surfactant (Dai-ichi Kogyo Seiyaku Co., Ltd.: Neogen SC) | 3.0 mass parts |
| deionized water | 78.0 mass parts |
| The preceding were mixed and were dispersed using a sand grinder mill. | |
| (Mixture production) | |
| resin particle dispersion 1 | 150.0 mass parts |
| resin particle dispersion 2 | 77.5 mass parts |
| colorant particle dispersion | 27.5 mass parts |
| wax particle dispersion | 45.0 mass parts |

The preceding were introduced into a 1-liter separable flask fitted with a stirrer, condenser, and thermometer and were stirred. The resulting mixture was brought to pH=5.2 using 1 mol/L potassium hydroxide. 120.0 mass parts of an 8% aqueous sodium chloride solution was added dropwise as a coalescing agent to this mixture, and heating was carried out to a temperature of 55° C. while stirring. Upon reaching this temperature, 10.0 mass parts of the charge control particle dispersion was added. After holding for 2 hours at a temperature of 55° C., observation with an optical microscope showed that aggregate particles with an average particle diameter of 3.2 μm had been formed.

A supplementary addition of 3.0 mass parts of an anionic surfactant (Dai-ichi Kogyo Seiyaku Co., Ltd.: Neogen SC) was subsequently made, followed by heating to a temperature of 95° C. while continuing to stir and then holding for 4.5 hours. This was followed by cooling, filtration of the reaction product, thorough washing with deionized water, and then fluidized bed drying at a temperature of 45° C. to obtain toner particles. These toner particles contained 65.0 mass parts of the styrene-acrylic resin, 35.0 mass parts of the block polymer, 5.5 mass parts of the cyan colorant, 9.0 mass parts of the wax, and 0.6 mass parts of the negative charging charge control agent.

A toner 41 was obtained by mixing 100.0 mass parts of these toner particles for 15 minutes using a Henschel mixer (Mitsui Miike Chemical Engineering Machinery Co., Ltd.) at a stirring rate of 3,000 rpm with 1.5 mass parts of an external additive in the form of hydrophobic finely divided silica particles (primary particle diameter: 7 nm, BET specific surface area: 130 $m^2/g$) provided by the treatment of finely divided silica particles with a dimethylsilicone oil at 20.0 mass % with reference to the finely divided silica particles. Toner 41 had the following: ΔSP value=0.18, D1=4.5 μm, and D4=6.2 μm.

<Production of Toner 42>

The following materials were preliminarily mixed and were melt-kneaded with a twin-screw extruder, and the cooled kneaded material was pulverized with a hammer mill and the obtained pulverized material was classified to obtain toner particles.

| | |
|---|---|
| binder resin (styrene-n-butyl acrylate copolymer resin (Mw = 30, 000, Tg = 50° C.)) | 65.0 mass parts |
| block polymer 1 | 35.0 mass parts |
| C.I. Pigment Blue 15:3 | 5.5 mass parts |
| metal compound of a dialkylsalicylic acid (Orient Chemical Industries Co., Ltd.: BONTRON E88) | 3.0 mass parts |
| hydrocarbon wax (melting point = 78° C.) | 6.0 mass parts |

A toner 42 was obtained by mixing 100.0 mass parts of the obtained toner particles for 15 minutes using a Henschel mixer (Mitsui Miike Chemical Engineering Machinery Co., Ltd.) at a stirring rate of 3,000 rpm with 1.5 mass parts of an external additive in the form of hydrophobic finely divided silica particles (primary particle diameter: 7 nm, BET specific surface area: 130 $m^2/g$) provided by the treatment of finely divided silica particles with a dimethylsilicone oil at 20.0 mass % with reference to the finely divided silica particles. Toner 42 had the following: ΔSP value=0.18, D1=4.4 μm, and D4=5.9 μm.

<Production of Comparative Toner 1>

A comparative toner 1 was obtained by the same production method as for toner 1, but in this case changing the block polymer 1 (35.0 mass parts) used in the production of toner 1 to comparative polymer 1 (35.0 mass parts). Comparative toner 1 had the following: ΔSP value=0.05, D1=4.1 μm, and D4=5.9 μm.

<Production of Comparative Toner 2>

A comparative toner 2 was obtained by the same production method as for toner 1, but in this case changing the block polymer 1 (35.0 mass parts) used in the production of toner 1 to comparative polymer 2 (35.0 mass parts). Comparative toner 2 had the following: ΔSP value=0.43, D1=4.2 μm, and D4=5.9 μm.

<Production of Comparative Toner 3>

A comparative toner 3 was obtained by the same production method as for toner 1, but in this case changing the block polymer 1 (35.0 mass parts) used in the production of toner 1 to comparative polymer 3 (20.0 mass parts) and bis(p-methylbenzylidene)sorbitol (1.0 mass parts). Comparative toner 3 had the following: D1=4.2 μm and D4=5.9 μm.

<Image Evaluations>

The image evaluations were performed using a partially modified commercial color laser printer (HP Color LaserJet 3525dn). The modifications enabled operation with just a single color process cartridge installed. The modifications also enabled the temperature in the fixing unit to be freely changed. The toner in the black toner process cartridge installed in this color laser printer was extracted; the interior was cleaned with an air blower; the particular toner (300 g) was introduced into the process cartridge; the toner-refilled process cartridge was installed in the color laser printer; and the image evaluations described herebelow were performed. The specific image evaluation items are as follows.

(The Low-Temperature Fixability)

A solid image (toner laid-on amount: 0.9 $mg/cm^2$) on the transfer material was evaluated at different fixation temperatures. The fixation temperature here is the value measured for the surface of the fixing roller using a contactless thermometer. Letter-size plain paper (XEROX 4200 Paper, Xerox Corporation, 75 $g/m^2$) was used for the transfer material. In the present invention, C and above are acceptable levels.

(Evaluation Criteria)

A: no offset at 100° C.

B: offset is produced at 100° C.

C: offset is produced at 110° C.

D: offset is produced at 120° C.

(Gloss)

The gloss value was measured using a PG-3D (Nippon Denshoku Industries Co., Ltd.) on a solid image (toner laid-on amount: 0.6 $mg/cm^2$) for a fixation temperature of 170° C. Letter-size plain paper (XEROX 4200 Paper, Xerox Corporation, 75 $g/m^2$) was used for the transfer material.

(Evaluation Criteria)

A: the gloss value is at least 30

B: the gloss value is at least 20 but less than 30

C: the gloss value is at least 15 but less than 20

D: the gloss value is less than 15

(The High-Temperature Fixability)

A solid image (toner laid-on amount: 0.9 $mg/cm^2$) on the transfer material was evaluated at different fixation temperatures (from at least 190° C. to not more than 210° C.). The fixation temperature here is the value measured for the surface of the fixing roller using a contactless thermometer. Letter-size plain paper (XEROX 4200 Paper, Xerox Corporation, 75 $g/m^2$) was used for the transfer material. In the present invention, C and above are acceptable levels.

(Evaluation Criteria)

A: no offset at 210° C.

B: offset is produced at 210° C.

C: offset is produced at 200° C.

D: offset is produced at 190° C.

(Development Stripes)

After the completion of a print-out test in which 25,000 prints of a horizontal line image with a 1% print percentage were made in a normal-temperature normal-humidity environment (23° C. temperature/60% RH humidity: NN) or in a high-temperature high-humidity environment (33° C. temperature/85% RH humidity: HH), a halftone (toner laid-on amount: 0.6 $mg/cm^2$) image was printed out on letter-size plain paper (XEROX 4200 Paper, Xerox Corporation, 75 $g/m^2$) and an evaluation of the development stripes was performed. In the present invention, C and above are acceptable levels.

(Evaluation Criteria)

A: not produced

B: a development stripe is produced at from 1 location to not more than 3 locations C: a development stripe is produced at from 4 locations to not more than 6 locations D: a development stripe is produced at 7 or more locations, or is produced with a width of at least 0.5 mm (Fogging)

After the completion of a print-out test in which 25,000 prints of a horizontal line image with a 1% print percentage were made in a normal-temperature normal-humidity environment (23° C. temperature/60% RH humidity: NN) or in a high-temperature high-humidity environment (33° C. temperature/85% RH humidity: HH), a pause was carried out for 48 hours and the reflectance (%) was thereafter measured, using a "REFLECTOMETER MODEL TC-6DS" (Tokyo Denshoku Co., Ltd.), in the non-image area of an additionally printed-out image. The evaluation was performed using the numerical value (%) provided by subtracting the obtained reflectance (%) from the reflectance (%) of the unused print-out paper (plain paper) measured in the same manner. Here, a smaller numerical value denotes a greater suppression of image fogging. The evaluation was carried out using general-purpose paper (HP Brochure Paper 200 g, Glossy, 200 g/m$^2$, from HP) in glossy paper mode. In the present invention, C and above are acceptable levels.

(Evaluation Criteria)

A: less than 5%

B: at least 0.5% but less than 1.5%

C: at least 1.5% but less than 3.0%

D: at least 3.0%

(The Heat-Resistant Storability (Blocking))

5 g of the particular toner was placed in a 50-cc plastic cup and was held for 3 days at a temperature of 55° C./humidity of 10% RH, and the evaluation was then performed by checking for the presence/absence of aggregate lumps. In the present invention, C and above are acceptable levels.

(Evaluation Criteria)

A: no aggregate lumps are produced

B: minor aggregate lumps are produced and are collapsed by light finger pressure C: aggregate lumps are produced and are not collapsed by light finger pressure D: complete aggregation Examples 1 to 46

The evaluations described above were carried out in Examples 1 to 46 using each of the toners 1 to 46 as the toner. The results of these evaluations are given in Table 5.

Comparative Examples 1 to 3

The evaluations described above were carried out in Comparative Examples 1 to 3 using each of comparative toners 1 to 3 as the toner. The results of these evaluations are given in Table 5.

TABLE 5

| | | low-temperature | | high-temperature | development stripes | | fogging | | |
|---|---|---|---|---|---|---|---|---|---|
| Example | toner | fixability | gloss | fixability | NN | HH | NN | HH | blocking |
| Example 1 | toner 1 | A | A(36) | A | A(0) | A(0) | A(0.1) | A(0.2) | A |
| Example 2 | toner 2 | A | A(35) | A | A(0) | A(0) | A(0.1) | A(0.2) | A |
| Example 3 | toner 3 | A | A(39) | A | A(0) | B(1) | A(0.2) | A(0.3) | B |
| Example 4 | toner 4 | A | A(37) | A | A(0) | A(0) | A(0.1) | A(0.2) | A |
| Example 5 | toner 5 | A | A(35) | A | A(0) | A(0) | A(0.1) | A(0.2) | A |
| Example 6 | toner 6 | A | A(36) | A | A(0) | A(0) | A(0.1) | A(0.2) | A |
| Example 7 | toner 7 | A | A(37) | A | A(0) | A(0) | A(0.1) | A(0.2) | A |
| Example 8 | toner 8 | A | A(36) | A | A(0) | A(0) | A(0.1) | A(0.2) | A |
| Example 9 | toner 9 | A | A(37) | A | A(0) | A(0) | A(0.1) | A(0.2) | A |
| Example 10 | toner 10 | A | A(37) | A | A(0) | A(0) | A(0.1) | A(0.2) | A |
| Example 11 | toner 11 | B | B(28) | A | A(0) | A(0) | A(0.1) | A(0.2) | A |
| Example 12 | toner 12 | A | A(35) | A | A(0) | A(0) | A(0.1) | A(0.2) | A |
| Example 13 | toner 13 | A | A(35) | A | A(0) | A(0) | A(0.1) | A(0.2) | A |
| Example 14 | toner 14 | A | A(36) | A | B(1) | B(2) | B(0.6) | B(0.9) | B |
| Example 15 | toner 15 | A | A(37) | A | A(0) | B(1) | B(0.6) | B(0.7) | B |
| Example 16 | toner 16 | A | A(36) | A | A(0) | B(1) | A(0.2) | B(0.6) | B |
| Example 17 | toner 17 | B | B(27) | A | A(0) | A(0) | A(0.1) | A(0.2) | A |
| Example 18 | toner 18 | C(110) | C(18) | A | A(0) | A(0) | A(0.1) | A(0.2) | A |
| Example 19 | toner 19 | A | A(39) | B | A(0) | B(1) | A(0.2) | B(0.6) | A |
| Example 20 | toner 20 | A | A(39) | B | B(2) | C(4) | B(0.6) | B(0.9) | A |
| Example 21 | toner 21 | A | A(37) | A | A(0) | B(1) | A(0.2) | B(0.6) | B |
| Example 22 | toner 22 | B | A(37) | A | B(2) | C(4) | B(0.6) | B(0.9) | B |
| Example 23 | toner 23 | B | B(28) | A | A(0) | A(0) | A(0.1) | A(0.2) | A |
| Example 24 | toner 24 | C(111) | B(29) | A | A(0) | A(0) | A(0.1) | A(0.2) | A |
| Example 25 | toner 25 | A | A(37) | A | B(1) | B(2) | A(0.2) | B(0.6) | B |
| Example 26 | toner 26 | A | A(37) | A | B(2) | C(4) | B(0.6) | B(0.9) | C |
| Example 27 | toner 27 | B | B(28) | A | A(0) | A(0) | A(0.1) | A(0.2) | A |
| Example 28 | toner 28 | C(111) | C(19) | A | A(0) | A(0) | A(0.1) | A(0.2) | A |
| Example 29 | toner 29 | A | A(37) | A | A(0) | B(1) | A(0.1) | A(0.3) | B |
| Example 30 | toner 30 | A | A(39) | B | B(1) | B(2) | A(0.2) | A(0.3) | C |
| Example 31 | toner 31 | B | B(28) | A | A(0) | A(0) | A(0.1) | A(0.2) | A |
| Example 32 | toner 32 | B | C(19) | A | A(0) | A(0) | A(0.1) | A(0.2) | A |
| Example 33 | toner 33 | B | B(27) | A | A(0) | A(0) | A(0.1) | A(0.2) | A |
| Example 34 | toner 34 | A | A(37) | A | C(4) | C(5) | C(1.6) | B(0.9) | C |
| Example 35 | toner 35 | B | B(28) | A | A(0) | A(0) | A(0.1) | A(0.2) | A |
| Example 36 | toner 36 | A | A(37) | A | A(0) | A(0) | A(0.1) | A(0.2) | A |
| Example 37 | toner 37 | B | B(27) | A | A(0) | A(0) | A(0.1) | A(0.2) | A |
| Example 38 | toner 38 | A | A(35) | A | A(0) | A(0) | A(0.1) | A(0.2) | A |
| Example 39 | toner 39 | B | B(27) | A | A(0) | A(0) | A(0.1) | A(0.2) | A |
| Example 40 | toner 40 | A | A(35) | A | A(0) | B(1) | A(0.1) | A(0.3) | A |
| Example 41 | toner 41 | A | A(37) | A | B(1) | B(2) | A(0.2) | B(0.6) | B |
| Example 42 | toner 42 | A | A(37) | A | A(0) | B(1) | B(0.6) | B(0.7) | B |

TABLE 5-continued

| Example | toner | low-temperature fixability | gloss | high-temperature fixability | development stripes NN | development stripes HH | fogging NN | fogging HH | blocking |
|---|---|---|---|---|---|---|---|---|---|
| Comparative Example 1 | comparative toner 1 | A | A(32) | A | D(7) | D(10) | D(3.7) | D(4.8) | D |
| Comparative Example 2 | comparative toner 2 | D(123) | C(15) | C | A(0) | A(0) | A(0.2) | A(0.3) | A |
| Comparative Example 3 | comparative toner 3 | D(133) | D(11) | C | D(7) | D (3 mm) | D(4.8) | D(6.2) | C |
| Example 43 | toner 43 | C(113) | C(18) | A | A(0) | A(0) | A(0.1) | A(0.2) | A |
| Example 44 | toner 44 | C(118) | C(18) | A | A(0) | A(0) | A(0.1) | A(0.1) | A |
| Example 45 | toner 45 | A | A(39) | B | B(2) | C(4) | A(0.2) | A(0.3) | C |
| Example 46 | toner 46 | A | A(39) | B | C(6) | C(6) | A(0.3) | A(0.3) | C |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-247691, filed Nov. 29, 2013 which is hereby incorporated by reference herein in its entirety.

What is claimed is:

1. A toner comprising a toner particle that contains a binder resin that contains a styrene-acrylic resin and a block polymer, wherein the block polymer has a polyester segment and a vinyl polymer segment;

the polyester segment is obtained by condensation polymerization of a monomer (a) and a monomer (b);

the monomer (a) is one or more selected from the group consisting of the monomer group A described below;

the monomer (b) is one or more selected from the group consisting of the monomer group B described below; and a content, in the polyester segment, of a substructure originating with the monomer (b) as calculated from the following formula is from at least 1.0 mol % to not more than 30.0 mol %:

$$\{\text{monomer } (b)\ [\text{mol}]/(\text{monomer } (a)\ [\text{mol}]+\text{monomer } (b)\ [\text{mol}])\}\times 100$$

Monomer group A: straight-chain α,ω-aliphatic diols having from at least 2 to not more than 11 carbons, straight-chain α,ω-aliphatic dicarboxylic acids having from at least 2 to not more than 13 carbons, straight-chain α,ω-aliphatic monohydroxymonocarboxylic acids having from at least 2 to not more than 12 carbons, and compounds provided by converting a carboxyl group in these compounds into an acid anhydride, alkyl ester, or lactone;

Monomer group B: straight-chain α,ω-aliphatic dicarboxylic acids having from at least 14 to not more than 24 carbons, straight-chain α,ω-aliphatic diols having from at least 12 to not more than 22 carbons, straight-chain α,ω-aliphatic monohydroxymonocarboxylic acids having from at least 13 to not more than 23 carbons, straight-chain aliphatic primary monocarboxylic acids having from at least 13 to not more than 23 carbons, straight-chain aliphatic primary monoalcohols having from at least 12 to not more than 22 carbons, and compounds provided by converting a carboxyl group in these compounds into an acid anhydride, alkyl ester, or lactone.

2. The toner according to claim 1, wherein a content of the block polymer in the binder resin is from at least 2.0 mass % to not more than 50.0 mass %.

3. The toner according to claim 2, wherein the content of the block polymer in the binder resin is from at least 6.0 mass % to not more than 50.0 mass %.

4. The toner according to claim 1, wherein a mass ratio (the C/A ratio) between the polyester segment and the vinyl polymer segment in the block polymer is from 40:60 to 80:20.

5. The toner according to claim 1, wherein a weight-average molecular weight (Mw) of the vinyl polymer segment in the block polymer is from at least 3,000 to not more than 14,000.

6. The toner according to claim 1, wherein a weight-average molecular weight (Mw) of the block polymer is from at least 15,000 to not more than 45,000.

7. The toner according to claim 6, wherein the weight-average molecular weight (Mw) of the block polymer is from at least 20,000 to not more than 45,000.

8. The toner according to claim 1, wherein an absolute value (ΔSP value) of a difference between a solubility parameter (SP) value of the styrene-acrylic resin and a solubility parameter (SP) value of the polyester segment in the block polymer is from at least 0.00 to not more than 0.30.

9. The toner according to claim 1, wherein a melting point of the block polymer is from at least 55° C. to not more than 80° C.

10. The toner according to claim 1, wherein the toner particle is a toner particle produced by a suspension polymerization method.

* * * * *